US007529504B2

(12) United States Patent
Inagaki et al.

(10) Patent No.: US 7,529,504 B2
(45) **Date of Patent: *May 5, 2009**

(54) ORGANIC PHOTOCONDUCTOR, PROCESS CARTRIDGE AND IMAGE FORMING APPARATUS BOTH EMPLOYING THE SAME

(75) Inventors: Keiichi Inagaki, Hino (JP); Shigeaki Tokutake, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 544 days.

This patent is subject to a terminal disclaimer.

(21) Appl. No.: 11/187,459

(22) Filed: Jul. 22, 2005

(65) Prior Publication Data

US 2007/0019984 A1 Jan. 25, 2007

(51) Int. Cl.
*G03G 21/18* (2006.01)
*G03G 15/02* (2006.01)
*G03G 5/047* (2006.01)

(52) U.S. Cl. ..... 399/116; 399/159; 399/174; 399/175; 399/176; 430/58.05; 430/66; 430/67

(58) Field of Classification Search ..... 430/58.05, 430/66, 67, 123.47, 123.42; 399/174, 175, 399/176, 116, 159
See application file for complete search history.

(56) References Cited

U.S. PATENT DOCUMENTS 5,430,526 A * 7/1995 Ohkubo et al. ..... 399/159
6,215,971 B1 * 4/2001 Sakoh et al. ..... 399/159
7,022,450 B2 4/2006 Asano et al.
7,041,419 B2 5/2006 Tokutake et al.
7,378,212 B2 * 5/2008 Inagaki et al. ..... 430/120.1
2003/0099488 A1 * 5/2003 Tanaka et al. ..... 399/176
2003/0190543 A1 * 10/2003 Sugiura et al. ..... 430/108.6
2004/0022558 A1 * 2/2004 Okano et al. ..... 399/175
2005/0186494 A1 * 8/2005 Inagaki et al. ..... 430/66
2007/0003848 A1 * 1/2007 Tokutake et al. ..... 430/45

FOREIGN PATENT DOCUMENTS

JP 2003-270810 * 9/2003

OTHER PUBLICATIONS

Japanese Patent Office machine-assisted translation of JP 2003-270810 (pub. Sep. 2003).*

Japanese Patent Office English-language abstract describing JP 05-072753 (pub. Mar. 26, 1993).*

Japanese Patent Office English-language abstract describing JP 11-327190 (pub. Nov. 26, 1999).*

(Continued)

*Primary Examiner*—Janis L Dote
(74) *Attorney, Agent, or Firm*—Squire, Sanders & Dempsey L.L.P.

(57) ABSTRACT

An image forming apparatus has an organic photoconductor having a surface layer containing fluorine-containing resin particles whose number average primary particle size is not less than 0.02 μm and is less than 0.20 μm; a charging device to charge by bring an charging member in contact with the organic photoconductor; a latent image forming device to for a latent image on the organic photoconductor; a developing device to visualize the latent image with toner and to form a toner image on the organic photoconductor; and a transferring device to transfer the toner onto a transfer material.

20 Claims, 4 Drawing Sheets

OTHER PUBLICATIONS

Japanese Patent Office English-language abstract describing JP 2003-076041 (pub. Mar. 14, 2003).*
Japanese Patent Office English-language abstract describing JP 2003-316044 (pub. Nov. 6, 2003).*
Japanese Patent Office English-language abstract describing JP 2004-004504 (pub. Jan. 8, 2004).*
Japanese Patent Office English-language abstract describing JP 2004-093865 (pub. Mar. 25, 2004).*
Notice of Rejection issued by JPO on Feb. 19, 2008, in connection with App. No. 2004-225298, 4 pgs.
Translation of Notice of Rejection issued by JPO on Feb. 19, 2008, 5 pgs.

* cited by examiner

ORGANIC PHOTOCONDUCTOR, PROCESS CARTRIDGE AND IMAGE FORMING APPARATUS BOTH EMPLOYING THE SAME

BACKGROUND OF THE INVENTION

The present invention relates to an organic photoconductor used in the field of a copying machine and a printer, a process cartridge and an image forming apparatus both employing the organic photoconductor.

Compared with an inorganic photoconductor such as a selenium-based photoconductor and an amorphous silicone photoconductor, an organic photoconductor has great advantages including a broad range of selection for materials, an excellent aptitude for environment and low manufacturing cost, and the organic photoconductor has recently become a leading electrophotographic photoconductor, replacing an inorganic photoconductor.

In an image forming method based on Carlson method, on the other hand, an organic photoconductor is charged electrically, then, an electrostatic latent image is formed thereon, then, a toner image is formed therefrom, and the toner image is transferred onto a transfer sheet to be fixed thereon to become a final image.

A corona discharger representing a discharging member that has been used typically as a member of the aforementioned charging means is known exceedingly. The corona discharger has an advantage that stable charging can be carried out. However, the corona discharger needs to be applied with high voltage, and therefore, an amount of generation of ionized oxygen, ozone, moisture and nitrogen oxide is large, resulting in problems that the organic photoconductor (hereinafter referred to also as photoconductor) is deteriorated, and the human body is adversely affected.

Accordingly, there has recently been studied a use of a contact charging method that employs no corona discharger. Specifically, voltage is impressed on a magnetic brush and a conductive roller which are charging members, and these members are brought into contact with a photoconductor representing an object to be charged, so that a surface of the photoconductor is charged to the prescribed voltage. If the contact charging method of this kind is used, lower voltage can be used and an amount of ozone generation is less, compared with a non-contact charging method employing a corona discharger.

The contact charging method is a method to impress DC voltage on which DC or AC is superposed on a charging member having resistance of about $10^2$-$10^{10}\Omega\cdot$cm, then, to bring the charging member into pressure contact with the photoconductor to give it electric charges. Since this charging method is carried out by discharge from the charging member to the object to be charged, under Paschen's law, charging is started by impressing voltage that is not less than the threshold value. Compared with a corona charging method, voltage to be impressed on the charging member is lower, and an amount of generation of ozone and nitrogen oxide is less, in this contact charging method.

On the other hand, in the recent image forming method, digitizing has been advanced, and an image forming method using a laser beam as an exposure light source is commonly used for forming an electrostatic latent image of an organic photoconductor.

However, in contact charging method with a charging roller, if a support of organic photoconductor processed to prevent interference fringes (hereinafter referred to as moiré) caused by laser beam exposure is used, namely, if an aluminum support whose surface is roughened by cutting is used, there is caused a problem that dielectric breakdown is easily caused by convex portions on the surface subjected to cutting. Further, if the surface of the organic photoconductor is charged repeatedly, cracks and contamination are generated on the organic photoconductor, resulting in various troubles that electric charges are concentrated on a portion of cracks and contamination, image defects such as dielectric breakdown and black spots are easily generated, and blurred images tend to be caused. In particular, these problems tend to occur under the conditions of high temperature and high humidity, and low temperature and low humidity.

In addition, the organic photoconductor has a problem that its surface tends to be worn away because of friction against the contact charging member or a cleaning member. For preventing deterioration of this surface layer caused by abrasion, there is proposed a photoconductor wherein polycarbonate resin having high abrasion resistance, namely, polycarbonate resin in which a central carbon atom is a cyclohexylene group (which is known as polycarbonate Z (that is also called BPZ simply), is used in a binder for a charge transport layer (Patent Document 1).

However, if abrasion resistance of the organic photoconductor is improved by using the binder stated above, inorganic external additives such as silica in a developer is embedded in the surface of the organic photoconductor by pressure of the contact charging member, thus, the surface of the organic photoconductor tends to be contaminated by components of the external additives, and dash mark (small streak images in a form of a comet) and dielectric breakdown are easily caused, although abrasion resistance is improved.

As an organic photoconductor that is fit for the contact charging method, there is proposed an organic photoconductor having in its surface layer the fine particles of fluorine-containing resin for preventing image roughness caused by dielectric breakdown or scratches which result from the contact charging means (Patent Document 2). Further, as a photoconductor suitable for a contact type charging method, it has been proposed to provide a charge injecting layer in a photoconductor in which the charge injecting layer contains fluorine-containing resin particles, and it is reported that problems of unsharp image and scratching can be improved (Patent Document 3). However, in the organic photoconductor having in its surface the particles of fluorine-containing resin which has been reported so far, a fluorine-containing resin particle is easily separated from the binder on a boundary between them in the surface layer, thus, electric charges of the contact charging means tend to flow in the boundary surface, and dielectric breakdown and black spots are easily generated. Further, external additives of toner concerning the contact charging means easily adhere to the boundary surface between the fluorine-containing resin particle and the binder, and blurred images and dash mark (small streak images in a form of a comet) are generated, which easily deteriorates sharpness of text images and halftone images.

As a means to improve adhesion of foreign substances to a surface of the photoconductor, there has been reported a technology to use fluorine-containing resin particles having low crystallinity (a half band width of a peak of X-ray diffraction pattern is not less than 0.28) (Patent Document 4). However, in the fluorine-containing resin particles having low crystallinity, fluorine-containing resin particles tend to adhere to each other, dispersion stability in coating dispersion is low, the particles tend to cohere each other to form a coarse aggregated particle, resulting in problems that a surface layer having uniform characteristics is hardly formed, dash marks and blurred images are generated and halftone images are roughened.

(Patent Document 1) TOKKAISHO No. 60-172044
(Patent Document 2) TOKKAI No. 2002-278096
(Patent Document 3) TOKKAISHO No. 2003-5411
(Patent Document 4) TOKKAIHEI No. 8-328287

SUMMARY OF THE INVENTION

An object of the invention is to solve the aforementioned problems of the organic photoconductor used in an image forming apparatus of a contact charging type, and in particular, to solve the aforesaid problems of the organic photoconductor having the surface layer containing fluorine-containing resin particles and to prevent generation of image defects such as dielectric breakdown, black spots or dash marks and thereby to provide an organic photoconductor, a process cartridge and an image forming apparatus which can form images having excellent sharpness and stability for a long time.

An aspect of the invention is an image forming apparatus, comprising:

an organic photoconductor having a surface layer containing fluorine-containing resin particles whose number average primary particle size is from not less than 0.02 μm to less than 0.20 μm, and the surface has dispersion of contact angle of ±2.0°; and a charging device to charge the organic photoconductor by bring an charging member in contact with the organic photoconductor.

Another aspect of the invention is a method for forming an image employing the image forming apparatus above.

DETAILED DESCRIPTION OF THE PREFERRED EMBODIMENT

Figure 1:
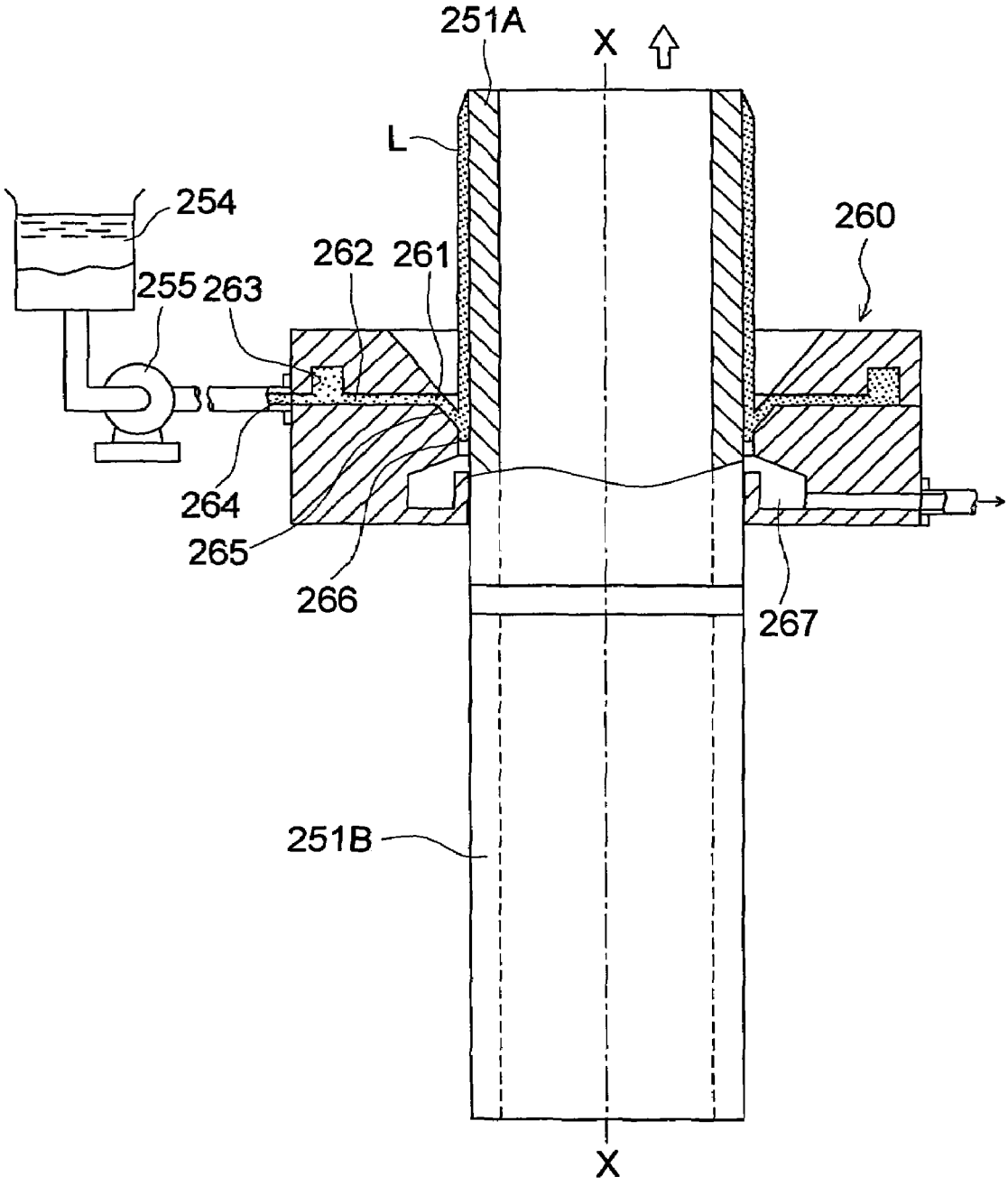
FIG. 1 is a sectional view of an example of a circular slide hopper type coating apparatus relating to the invention.

After studying the aforesaid problems of the organic photoconductor that is used for the image forming apparatus of a contact charging type, we found that generation of image defects such as dielectric breakdown, black spots or dash mark and blurred images can be prevented, and images which have excellent sharpness and are stable for a long time can be formed, by making the surface layer or the charge injecting layer of the organic photoconductor to contain fluorine-containing resin particles, preferably whose crystallinity is low, by making the fluorine-containing resin particles to be dispersed evenly in the surface layer, and by making dispersion of contact angles of the surface layer to be small. Namely, the invention can be attained by having the following structures.

One aspect of the invention can be an organic photoconductor comprising a surface layer containing fluorine-containing resin particles whose number average primary particle size is not less than 0.02 μm and is less than 0.20 μm.

The photoreceptor can be one that has therein a charging means that charges by bringing a charging member into contact with the organic photoconductor, a latent image forming means that forms an electrostatic latent image on the organic photoconductor, a developing means that forms a toner image on the organic photoconductor, by visualizing the electrostatic latent image with toner and a transfer means that transfers the toner image onto a transfer material, and is used in an image forming apparatus that forms electrophotographic images repeatedly.

In the aspect above, it is preferable that dispersion of the contact angle is ±2.0°, or a contact angle for water of the surface layer is 90° or more, preferably the surface layer satisfies the both.

Owing to the structure mentioned above, the organic photoconductor can prevent generation of dielectric breakdown, black spots, or dash mark and blurred images, and can form electrophotographic images of halftone images having excellent sharpness.

Another aspect of the invention can be an organic photoconductor having a photoconductive layer and a charge injecting layer on a conductive base support, the charge injecting layer contains fluorine-containing resin particles whose number average primary particle size is not less than 0.02 μm and is less than 0.20 μm.

In the aspect, it is preferably that dispersion of the contact angle of the charge injecting layer is ±2.0° or a contact angle for water is 90° or more, more preferably the charge injecting layer satisfies the both.

Namely, in the fluorine-containing resin particles, dispersion uniformity is poor as stated above, and it has been difficult to form a uniform and smooth film that is free from aggregate. That is, the fluorine-containing resin particles each having a small particle size tend to form aggregated particles, and in the organic photoconductor with a surface layer containing the aggregated particles, or in the organic photoconductor with a charge injecting layer containing binder resin and conductive particles, dispersion in contact angles is great, and if it is applied to the contact charging system, dielectric breakdown, black spots, or dash mark and blurred images are easily generated. As a result, it has been impossible to visualize highly detailed halftone images made by laser beams, but, an organic photoconductor with a surface layer, or an organic photoconductor with a charge injecting layer wherein dispersibility of fluorine-containing resin particles whose number average primary particle size is not less than 0.02 μm and is less than 0.20 μm is improved, and a contact angle for water of the surface layer or charge injecting layer is 90° or more, and dispersion of contact angles is formed to be ±2.0° can prevent generation of dielectric breakdown, black spots, or dash mark and blurred images, and can form electrophotographic images wherein halftone images are excellent.

Hereinafter, the surface layer contains charge injecting layer if there is no particular explanation.

With respect to the surface layer having the characteristics of the invention, it is possible to manufacture a stable dispersions by controlling mutual cohesiveness of the fluorine-containing resin particles, when dispersing dispersions of fluorine-containing resin particles whose number average primary particle size is not less than 0.02 μm and is less than 0.20 μm by an employing low-boiling point solvent having excellent dispersibility, preferably by employing an organic solvent having a boiling point of 120° C. or less under the pressure of the atmosphere (for example, THF, ethanol, toluene, dichloroethane or the like). At the same time, it is possible to form the surface layer wherein dispersibility of the fluorine-containing resin particles is excellent by preventing aggregation of the fluorine-containing resin particles in the surface layer and interfacial peeling between a fluorine-containing resin particle and binder resin, when forming a surface layer by using a coating apparatus of a coating solution supplying type and drying it. As a result, it is possible to form an organic photoconductor having a surface layer on which fluctuation of contact angles is small and surface energy is uniform, and thereby, to manufacture an organic photoconductor wherein generation of dielectric breakdown and black spots, or dash mark and blurred images can be prevented, and electrophotographic images in which sharpness of halftone images is excellent can be formed.

The coating apparatus of a coating solution supplying type mentioned above means a coating apparatus to coat by supplying a coating solution needed for layer formation onto a conductive support, and an example thereof includes a slide hopper type coating apparatus, an extrusion type coating apparatus and a spray coating apparatus. Compared with dipping coating to coat by dipping a conductive support in a coating solution, the coating apparatus of a coating solution supplying type has advantages that dispersions are not stagnated in the coating apparatus, a surface layer is formed on a one-way basis, and thereby, dispersed particles of the fluorine-containing resin particles are free from repeated aggregation shearing in dispersions, and a uniform surface layer having less aggregation of the fluorine-containing resin particles can be formed. In addition, aging aggregation of dispersions can be prevented because dispersions can be prepared for each manufacture of a photoconductor, and coating can be carried out without dissolving an underlayer which has already been formed on the conductive support in the course of forming a surface layer, which makes it possible to form a surface layer having uniform dispersions in which aggregation of the fluorine-containing resin particles is less even in the case of coating and drying.

Among the aforesaid coating solution supplying type coating apparatuses, a coating method employing a slide hopper type coating apparatus is most suitable for the occasion to use dispersions in which the low-boiling point solvent is used, as a coating solution, and in the case of a cylindrical photoconductor, it is preferable to coat by using a circular slide hopper type coating apparatus described fully in TOKKAISHO No. 58-189061.

The following gives a brief description of the circular quantity-regulated coating machine.

Figure 2:
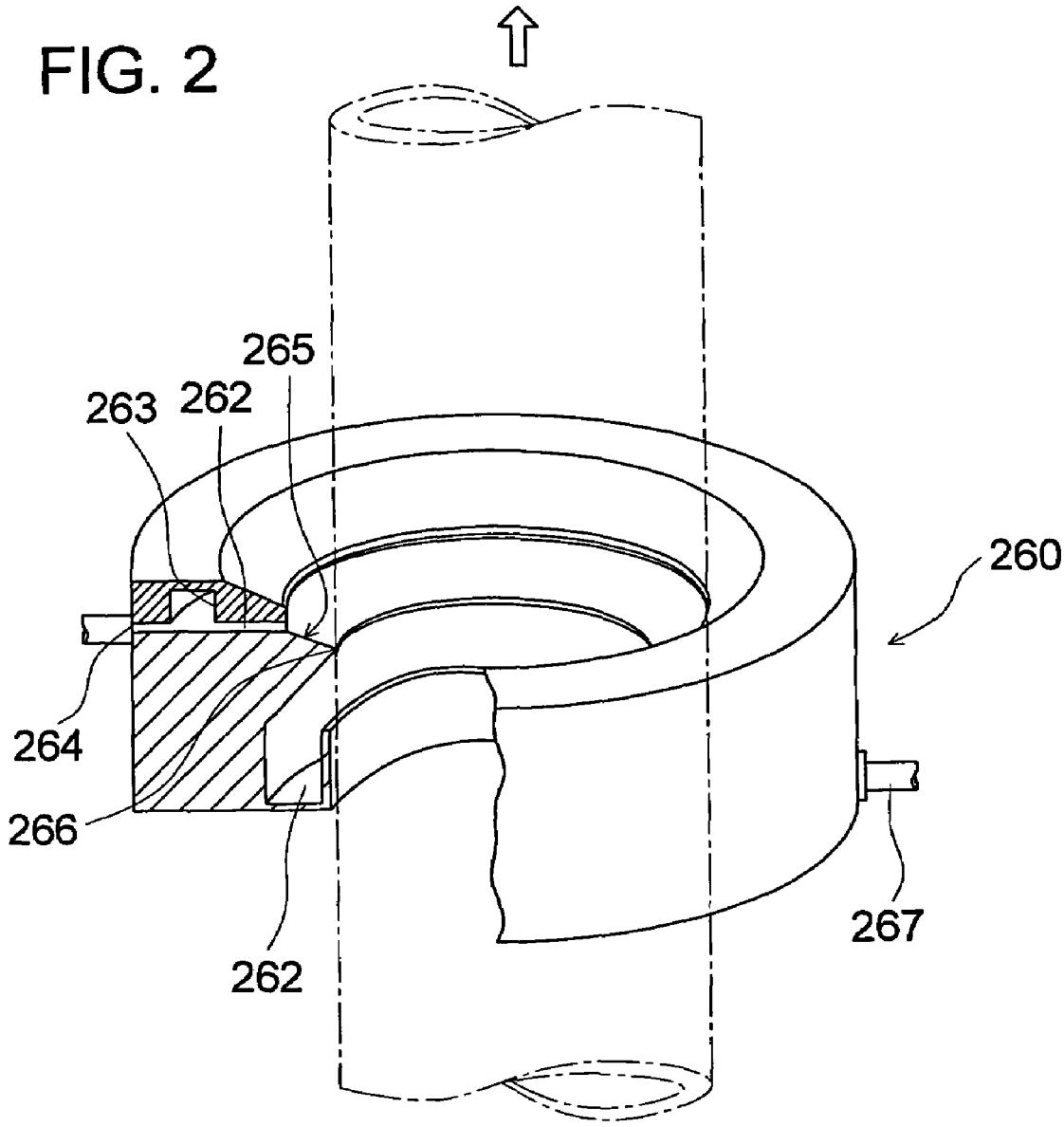
FIG. 2 is a perspective view of an example of a circular slide hopper type coating apparatus relating to the invention.

In the invention, a coating solution wherein fluorine-containing fine particles are dispersed is coated in a profitable way by using a circular slide hopper type coating apparatus. In an example of the circular slide hopper type coating apparatus, cylindrical base materials 251A and 251B connected vertically along center line XX are lifted continuously in the direction of an arrow as shown on a longitudinal sectional view in FIG. 1, for example, portion (which is simply called a coating head) 260 that is directly related to coating of the slide hopper type coating apparatus that surrounds the base material coats coating solution L on an outer circumferential surface of the base material 251. Incidentally, the base material may also be a base material of a seamless belt type, in addition to a hollow drum such as an aluminum drum and a plastic drum. AS shown in FIG. 2, on the coating head 260, there is formed narrow coating solution distributing slit (which is called a slit simply) having coating solution outlet 261 that is opened to the base material 251 side, in the horizontal direction. The slit 262 is communicated with annular coating solution distributing chamber 263, and coating solution L in reservoir tank 254 is supplied to this annular coating solution distributing chamber 263 through supply tube 264 by pressure pump 255. On the other hand, on the lower side of the coating solution outlet 261 of the slit 262, there is formed slide surface 265 which is inclined downward continuously and is formed to be a terminal end whose dimension is slightly greater than the outer dimension of the base material. Further, there is formed lip portion (bead: solution pool) 266 that extends downward from the terminal end of the slide surface 265. In coating conducted by the coating apparatus of this kind, coating solution L is extruded from the slit 262 in the course of lifting the base material 251, when the coating solution flows down along the slide surface 265, a photosensitive solution which has arrived at the terminal end of the slide surface forms a bead between the terminal end of the slide surface and an outer circumferential surface of the base material 251, and then, is coated on the surface of the base material. Excessive photosensitive solutions are ejected from ejection section 267.

The circular slide hopper type coating apparatus makes coating solution to flow down along slide surface 265, and a coating solution arriving at a terminal end of the slide surface 265 forms a bead between the terminal end of the slide surface 265 and cylindrical base material 251A, thus, a coated film is formed on the cylindrical base material.

In the coating method employing the circular slide hopper type coating apparatus, the terminal end of the slide surface and a base material are arranged with a gap (approx. 2 μm-2 mm) between them, therefore, the base material is not damaged, and even when many layers each being different from others in terms of characteristic are formed, coating can be carried out without damaging the layer which has been coated already. Further, even when forming layers each being different from others in terms of characteristics and being dissolved in the same solvent, on a multi-layer basis, components in the lower layer hardly elute to the upper layer side because of the period of time of existence in the solvent is shorter than that in a dipping coating method, and coating can be carried out without deteriorating dispersibility of fluorine-containing resin particles because coating can be conducted without eluting in a coating tank.

The fluorine-containing resin particles have a number average primary particle diameter from 0.02 μm inclusive to 0.20 μm exclusive. If the number average primary particle diameter is less than 0.02 μm, the stability of the dispersion solution may deteriorate and coagulation among the fluorine-containing resin particles may occur. This will make uniform dispersion difficult and will cause increased variations in the contact angle, with the result that the generation of dielectric breakdown and black spots, or dash mark and blurred images are easily occurred. If the number average primary particle diameter is greater than 0.20 μm, coagulated particles may be easily produced by flocculation, and variations in the contact angle of the layer containing the fluorine-containing resin particles may be increased. Thus, generation of dielectric breakdown and black spots, or dash mark and blurred images may be more likely to occur, and at the same time, the image exposure of laser beam or the like may scatter and the sharpness of the image may deteriorate. The number average primary particle diameter of the fluorine-containing resin particles not less than 0.02 μm and not more that to 0.18 μm may be more preferable.

The number average primary particle diameter of the fluorine containing resin particle (D1) can be measured by observing the cross section of the photoreceptor. To be more specific, a desired 100 particles are selected from a photograph taken by a transmission electron microscope (acceleration voltage: 200 kV) at the magnification of 50,000 and the Feret's diameter is measured to get the number average primary particle diameter (D1).

When the contact angle of the surface layer with respect to water is less than 90°, the toner contains a greater amount of deposits of the inorganic external additives such as silica, and the generation of dielectric breakdown and black spots, or dash mark and blurred images tend to occur. Further, there will be an increase in frictional drag with the contact member of the photoconductor such as a cleaning blade, and the amount of wear will be increased by fretting, so that streak-like irregularities of the image will occur and sharpness of the image will deteriorate more easily. The more preferred contact angle is 95° or more without exceeding 120°. If the contact angle has exceeded 120°, the amount of fine particles of fluorine-containing resin in the surface layer becomes excessive and the surface layer becomes soft. Fretting tends to occur, with the result that a blurred image will occur easily. In the meantime, if the variation of contact angle is out of the range ±2.0°, the dispersion property of the fine particles of fluorine-containing resin on the surface layer will be uneven, and inorganic components in the toner or paper powder, for example, inorganic external additives such as silica and titanium oxide in the toner, or the talc component will be embedded into the surface layer, with the result that the generation of dielectric breakdown and black spots, or dash mark and blurred images tend to be produced. Black and white streaks also tend to be produced. The variation in the contact angle is more preferred to be within ±1.7°.

Measurement of Contact Angle and its Variation

The contact angle in the sense is defined as the contact angle to the surface of a photoconductor with respect to pure water (at 20° C.). The contact angle of the photoconductor is obtained by measuring the contact angle with respect to pure water using a contact angle meter (Model CA-DT.A by Kyowa Kaimen Kagaku Co., Ltd.) at 20° C., 50% relative humidity.

The variation of the contact angle was measured at 20° C., 50% relative humidity. This measurement was started after repeated image formation of at least several sheets, when the photoconductor has conformed to the image formation. When the photoconductor was cylindrical, measurement was carried out at three positions—at the center and 5 cm from the right and left ends, and at four positions at each 90° in the circumferential direction—i.e. at a total of 12 positions. The average of these measurements was assumed as the contact angle, and the values farthest from this average value in the positive and negative directions were assumed as variations. Similarly, when the photoconductor was a sheet, measurement was carried out at three positions—at the center and 5 cm from the right and left ends, and at four positions at an equally spaced interval—i.e. at a total of 12 positions. The average of these measurements was assumed as the contact angle of the present invention, and the values farthest from this average value in the positive and negative directions were assumed as variations. In this case, the aforementioned center refers to the center with respect to the length in the perpendicular direction relative to the rotating direction of the photoconductor.

The fluorine-containing resin particles preferably have a crystallinity not less than 40% and less than 90%. If the crystallinity is 90% or more, the dispersion property of the fluorine-containing resin particles will be improved, but the spreading property of fluorine-containing resin particles per se will be reduced, and the variation of contact angle tends to increase. There is no lower limit of the aforementioned crystallinity so long as an object of the present invention can be achieved. If the crystallinity of the fluorine-containing resin particles is too small, spreading property will be excessive and the dispersion property tends to deteriorate; therefore, the fluorine-containing resin particles are preferred to have a crystallinity of 40% or more.

To measure the crystallinity of the fluorine-containing resin particles, the diffraction peak having occurred is separated into crystalline and non-crystalline portions according to wide-angle X-ray diffraction measurement. After baseline correction, the measurement is expressed in terms of the percentage of the X-ray integrated intensity of the crystalline portion (numerator) over the full X-ray integrated integrity of the crystalline and non-crystalline portions (denominator).

In the present invention, measurements were made using the following wide-angle X-ray diffraction measuring apparatus under the following measuring conditions. If the same results as those by the wide-angle X-ray diffraction measuring apparatus can be obtained, another measuring instrument can be utilized.

X-ray generator: Rigaku RU-200B

Output: 50 kV, 150 mA

Monochromator: Graphite

Radiation source: CuKα (0.154184 nm)

Scanning range: $3 \leqq 2\theta \leqq 60$

Scanning method: θ-2θ

Scanning rate: 2/min

As a material which constitutes fluorine-containing resin particles, it is desirable to use a homopolymer or a copolymer of a fluorine-containing polymerizable monomer, or a copolymer of a fluorine-containing polymerizable monomer and a fluorine free polymerizable monomer. A fluorine-containing polymerizable monomer is a monomer expressed with a general formula;

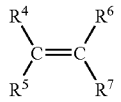

(In the formula, at least one group among $R^4$-$R^7$ is a fluorine atom, and the remaining groups are a hydrogen atom, a chlorine atom, a methyl group, a monofluoro methyl group, a difluoro methyl group, or a trifluoro methyl group independently, respectively). As a desirable fluorine-containing polymerizable monomer, ethylene tetrafluoride, ethylene trifluoride, ethylene chloride trifluoride, propylene hexafluoride, vinyl fluoride, vinylidene fluoride, ethylene dichloride difluoride, etc. may be listed. As a fluorine-containing polymerizable monomer, two or more kinds of monomers may be used.

As a fluorine free polymerizable monomer, vinyl chloride etc. may be listed, for example. As a fluorine free polymerizable monomer, two or more kinds of monomers may be used.

Among the constituting materials, it may be preferable to constitute any fluorine-containing resin particles by a homopolymer or a copolymer of a fluorine-containing polymerizable monomer, it may be more preferable to use a poly ethylene tetrafluoride(PTFE), poly ethylene trifluoride, and ethylene tetrafluoride-propylene hexafluoride copolymer and polyvinylidene fluoride, and it may be especially preferable to use poly ethylene tetrafluoride.

The number average molecular weight of a polymer which constitutes a fluorine-containing resin particle is not restricted especially as far as a purpose of the present invention can be attained, however usually the range of 10,000 to 1 million is suitable.

Although the degree of crystallinity of fluorine-containing resin particles changes according to the construction materials of the fluorine-containing resin particles, it is changed also by conducting heat-treating for the fluorine-containing resin particles. For example, if PTFE fine particles (polyethylene terephthalate fine particles) whose number average primary particle diameter is 0.12 μm and degree of crystallinity is 91.3 are heat-treated for 65 minutes at 250° C., degree of crystallinity can be reduced to 82.8. A heat treatment means in particular is not restricted, but a well-known dryer or a well-known heating furnace can be used.

As a binder resin in the above-mentioned surface layer, it is desirable to use a resin which has a surface activity group to help the dispersibility of fluorine-containing resin particles in a partial structure of the resin, for example, it is desirable to use polycarbonate and polyarylate which have a siloxane group in a partial structure. Especially, siloxane-modified polycarbonate which has a siloxane group shown below in a partial structure is desirable.

(PC-1)

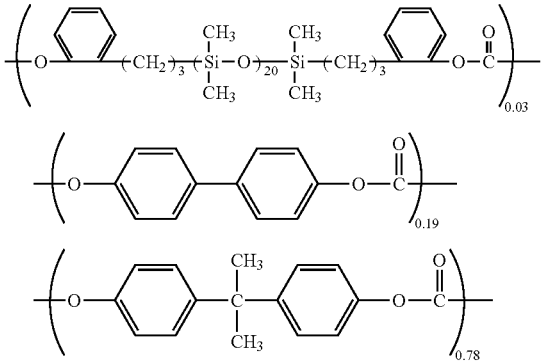

(PC-2)

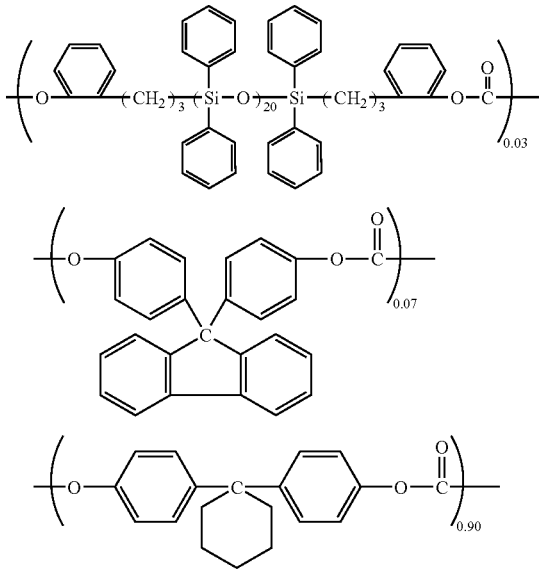

-continued (PC-3)

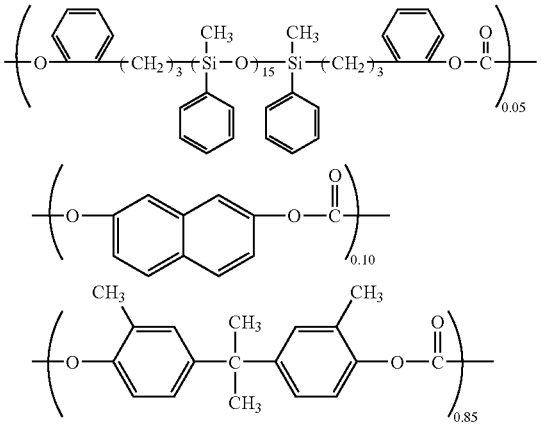

(PC-4)

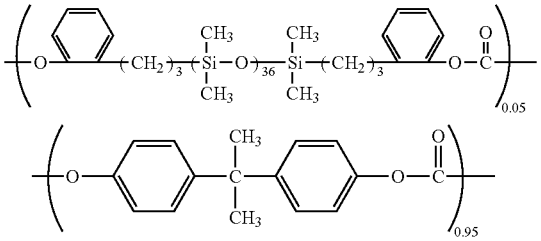

(PC-5)

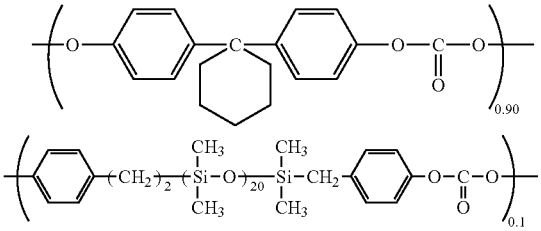

As for viscosity average molecular weight, 10,000-100,000 are desirable.

Further, to form by using the fluorine-containing resin particles a surface layer (or a charge injecting layer) whose contact angle for water is 90° or more and dispersion in a contact angle is ±2.0°, it is desirable to make the ratio of the fluorine-containing resin particles in the surface layer high, it is desirable to use it by an amount of at lest 20 mass parts and not more than 200 mass parts to 100 mass parts of the binder resin by a mass ratio. With this range, it is easy to form the surface layer satisfying both conditions that a contact angle for water is 90° or more and a dispersion in a contact angle is ±2.0°. Moreover, a surface layer becomes firm and it is hard to generate an abrasion mark etc.

The following describes the configuration of the organic photoconductor.

The organic photoconductor refers to an electrophotographic photoconductor equipped with at least one of a charge generating function essential to the configuration of the electrophotographic photoconductor, and a charge transport function. It includes all the photoconductors composed of the commonly known organic charge generating substances or organic charge transfer substances, and the known organic photoconductors such as the photoconductor wherein the charge generating function and charge transfer function are provided by the high-molecular complex.

There is no restriction to the configuration of the photoconductor if the surface layer of the photoconductor contains the fluorine-containing resin particles having a number average primary particle diameter from 0.02 μm inclusive to 0.20 μm exclusive, and the variation of contact angle is within ±2.0°. For example, it includes the following configurations:

1) A configuration wherein the photosensitive layer includes a charge generating layer, and a charge transport layer laid sequentially one on top of the other on a conductive support.

2) A configuration wherein the photosensitive layer includes a charge generating layer and the first and second charge transport layers laid sequentially one on top of another on a conductive support.

3) A configuration wherein the photosensitive layer includes a single layer containing a charge transport material and a charge generating material laid on a conductive support.

4) A configuration wherein the photosensitive layer includes a charge transport layer and a charge generating layer laid sequentially one on top of the other on a conductive support.

5) A configuration of the photoconductor described in the aforementioned 1) through 4) wherein a surface protective layer is further provided.

6) A configuration wherein the photosensitive layer includes a charge generating layer, a charge transport layer, and a charge injecting layer laid sequentially one on top of the other on a conductive support.

7) A configuration wherein the photosensitive layer includes a single layer comprising a charge transport material and a charge generating material and a charge injecting layer laid on the layer.

Incidentally, in the photoconductor, a substrate layer (an intermediate layer) may be formed on the conductive support, prior to the formation of the photosensitive layer, independently of the type of configuration adopted.

The photoconductor can be made in any one of the aforementioned configurations. The surface layer of the photoconductor is the layer in contact with the air boundary. When a single layer photosensitive layer alone is formed on the conductive support, this photosensitive layer corresponds to the surface layer. When a single layer or a laminated photosensitive layer and surface protective layer are laid on the conductive support, the surface protective layer serves as a surface layer. In the photoconductor, the configurations (2), (6) and (7) are preferably used. In the photoconductor, a substrate layer may be formed on the conductive support, prior to the formation of the photosensitive layer, independently of the type of configuration adopted.

The charge transport layer can be defined as a layer having a function of transporting the electric charge carrier generated on the charge generating layer due to light exposure, to the surface of the organic photoconductor. Specific detection of the charge transport function can be confirmed by laying the charge generating layer and charge transport layer on the conductive support, and by detecting the photoconductivity. In the configurations, at least one of the organic photoconductor comprises the above-mentioned charge injecting layer. Following is a description of the charge injecting layer.

Charge Injecting Layer

The organic photoconductor of the present invention can have a structure in which a charge injecting layer is provided as a surface layer as mentioned. The charge injecting layer can be basically constituted by a binder resin in which electroconductive fine particles are dispersed.

As the binder resin in the charge injecting layer, a hardened type resin may be preferable, because an environmental variation is small, it is excellent in wear resistance, it is excellent in dispersibility and dispersion stability for conductive particles or fluororesin containing particles.

In the hardened type resin, a phenol resin, acryl resin, epoxy resin, siloxane resin, etc. are desirable, and a heat curing type resole type phenol resin is especially desirable.

As the electroconductive fine particle of the charge injecting layer, anionic, cationic and nonionic organic electrolytes such as fatty acid salts, higher alcohols, sulfuric esters, fatty acid amines, quaternary ammonium salts, alkylpridium salts, polyoxyethylenealkyl ethers, polyoxyethylenealkyl esters, sorbitanealkyl esters and imidazoline derivatives; metals such as Au, Ag, Cu, Ni and Al; metal oxides such as ZnO, $TiO_2$, $SnO_2$, $In_2O_3$, $Sb_2O_3$-containing $SnO_2$ and $In_2O_3$-containing $SnO_2$; metal fluorides such as $MgF_2$, $CaF_2$, $BiF_3$, $AlF_3$, $SnF_2$, $SnF_4$ and $TiF_4$; organic titanium compounds such as tetraisopropyl titanate, tetranormalbutyl titanate, titanium acetylacetonate and ethyl titaniumlactate; and mixtures of them are employable.

In the charge injecting layer, the charge transfer material may be contained. The lowering of the sensitivity accompanied with the repeating use and the increasing of the remaining potential are also prevented by the presence of the charge transfer layer. It is preferable to add a compound having the anti-oxidation ability into the charge injecting layer.

The suitable thickness of the charge injecting layer is from 0.3 to 10 μm and is preferably from 1 to 5 μm.

The volume resistance of the charge injecting layer is preferably from $10^{10}$ to $10^{15}\Omega\cdot$cm, and particularly preferably from $10^{10}$ to $10^{14}\Omega\cdot$cm. The amount of the electroconductive fine particles is preferably as small as possible within the range in which the resistance and the remaining potential are acceptable since the strength of the layer is lowered accompanied with the increasing of the amount of the electroconductive fine particles.

The following describes a specific configuration of the photosensitive layer, with reference to an example of the layer configuration (2):

Conductive Support:

A sheet-like or cylindrical conductive support may be used as the conductive support for the photoconductor.

The cylindrical conductive support can be defined as a cylindrical support required to form images on an endless basis through rotation. The preferred cylindricity is 5 through 40 μm, and the more preferred one is 7 through 30 μm.

The cylindricity is based on the JIS (B0621-1984). To be more specific, when a cylindrical substrate is sandwiched between two coaxial geometrical cylinders, the cylindricity is expressed in terms of the difference of the radii at the position where a space between two coaxial cylinders is minimized. In the present invention, the difference in the radii is expressed in "μm". The cylindricity is gained by measuring the roundness at a total of seven points—two points 10 mm from both ends of the cylindrical substrate, a center, and four points obtained by dividing the space between both points and the center into three equal parts. A non-contact type universal roll diameter measuring instrument (by Mitsutoyo Co., Ltd.) can be used for this measurement.

The conductive support may include a metallic drum made of aluminum, nickel or the like, a plastic drum formed by vapor deposition of aluminum, tin oxide, indium oxide or the like, or a paper/plastic drum coated with conductive substance. The conductive support is preferred to have a specific resistance of $10^3$ Ωcm or less at the normal temperature.

A conductive support wherein the alumite film provided with porous sealing treatment on the surface is formed may be used. Alumite treatment is normally carried out in the acid bath containing a chromium oxide, sulfuric acid, oxalic acid, phosphoric acid, sulfamic acid or others. In sulfuric acid, the best result is obtained by anodization. In the case of anodization in sulfuric acid, preferred conditions include a sulfuric acid concentration of 100 through 200 g/l, aluminum ion concentration of 1 through 10 g/l, liquid temperature of around 20° C., and applied voltage of about 20 volts, without the preferred conditions being restricted thereto. The average thickness of the film formed by anodization is normally equal to or smaller than 20 μm, and is preferred to be equal to or smaller than 10 μm, in particular.

Intermediate Layer:

An intermediate layer equipped with barrier function can be provided between the conductive support and photosensitive layer.

It may be preferable that the intermediate layer used in the present invention contains N-type semi-conductive fine particles. The N-type semiconductive fine particle means that main charge carriers are particles of electrons. That is, since main charge carriers are particles of electrons, the intermediate layer in which the N-type semiconductive fine particles are contained in the insulating binder, effectively blocks the hole injection from the substrate and has a property having less blocking capability for the electron from the photosensitive layer.

The following describes the method of identifying the N-type semiconducting particles.

An intermediate layer having a film thickness of 5 μm (intermediate layer formed by using a dispersion having 50 wt % of particles dispersed in the binder resin constituting the intermediate layer) is formed on the conductive support. This intermediate layer is negatively charged and the light damping property is evaluated. Further, it is positively charged, and the light damping property is evaluated in the same manner.

The N-type semiconducting particles are defined as the particles dispersed in the intermediate layer in cases where the light damping property, when negatively charged in the aforementioned evaluation, is greater than that when positively charged.

The N-type semiconductive particles include the particles of titanium oxide ($TiO_2$), zinc oxide (ZnO) and tin oxide ($SnO_2$), and the titanium oxide is preferable.

As the N-type semiconductive particles, fine particles having the number average primary particle diameter of 3.0 nm to 200 nm, more preferably 5 to 100 nm. The number average primary order particle size of the N type semi-conductive fine particles described above is obtained by the following. For example, the titanium oxide particles are magnified by a factor of 10,000 according to a transmission electron microscope, and one hundred particles are randomly selected as primary order particles from the magnified particles, and are obtained by measuring an average value of the FERE diameter according to image analysis. The intermediate layer using the N-type semiconductive particles where the number average primary particle diameter is within the aforementioned range permits dispersion in the layer to be made more compact, and is provided with sufficient potential stability and black spot preventive function.

Titanium oxide is available in various crystal types such as anatase, rutile and amorphous type. Of these types, the rutile type titanium oxide pigment or anatase type titanium oxide pigment is particularly preferred since it enhances rectifying characteristics of charge through the intermediate layer, i.e., mobility of electron, whereby charge potential is stabilized and generation of transfer memory is prohibited as well as increase of residual potential is prohibited.

As the N-type semiconductive particles, a compound which is a polymer containing a methylhydrogensilixane unit and was subjected to a surface treatment compound is preferably used. The hydrogenpolysiloxane having a molecular weight of from 1,000 to 20,000 is easily available and shows a suitable black spot inhibiting ability, and gives good half tone image The polymer containing a methylhydrogensilixane unit is preferably a copolymer of a structural unit of —(HSi($CH_3$)O)— and another siloxane unit. Preferable another siloxane unit is a dimethylsioxane unit, a methylethylsiloxane unit, a methylphenylsiloxane unit and a diethylsiloxane unit, and the dimethylsiloxane unit is particularly preferred. The ratio of the methylhydrogensiloxane unit in the copolymer is from 10 to 99 mole percent, and preferably from 20 to 90 mole percent.

The methylhydrogensiloxane copolymer is preferably a random copolymer or a block copolymer, even though a random copolymer, a lock copolymer and a graft copolymer are usable. The copolymerizing composition other than the methylhydrogensiloxane may be one or more kinds.

The N-type semiconductor particle may be one subjected to surface treatment by a reactive organic compound represented by the following formula.

$$(R)_n—Si—(X)_{4-n}$$

In the above, Si is a silicon atom, R is an organic group directly bonded by the carbon atom thereof to the silicone atom, X is a hydrolyzable group and n is an integer of 0 to 3.

In the organic silicone compound represented by the above formula, the organic group represented by R which is directly bonded by the carbon atom thereof to the silicone atom is, for example, an alkyl group such as a methyl group, an ethyl group, a propyl group, a butyl group, a pentyl group, a hexyl group, an octyl group and a dodecyl group; an aryl group such as a phenyl group, a tolyl group, a naphthyl group and a biphenyl group; an epoxy group-containing group such as a γ-glycidoxypropyl group and a β-(3,4-epoxycyclohexyl) ethyl group; a (metha)acryloyl group-containing group such as a γ-acryloxpropyl group and a γ-methacryloxypropyl group; a hydroxyl group-containing group such as a γ-hydroxypropyl group and a 2,3-dihydroxypropyloxypropyl group, a vinyl group-containing group such as a vinyl group and a propenyl group; a mercapto group-containing group such as a γ-mercaptopropyl group: an amino group-containing such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluoroctylethyl group; and a nitro group and a cyano-substituted alkyl group. Examples of the hydrolyzable group include an alkoxy group such as a methoxy group and an ethoxy group; a halogen atom and an acyloxy group.

The organic silicone compound represented by the foregoing may be employed singly or in combination of two or more kinds thereof.

In the compounds represented by the foregoing organic silicone compound, plural groups represented by R may be the same or different when n is 2 or more.

The N-type semiconductor particle may be subjected to a surface treatment by alumina or silica before the surface treatment by the nethylhydrogensiloxane copolymer or the reactive organic silicone compound.

The treatment by alumina and that by silica may be performed simultaneously, and it is particularly preferable that the treatment by alumina is firstly carried out and then the treatment by silica is provided. The amount of silica is preferably larger than that of alumina when the treatments by alumina and silica are applied.

The surface treatment of the N-type semiconductor fine particle such as titanium oxide by alumina, silica or zirconia can be performed by a wet method. For example, the surface-treated N-type semiconductor particle can be prepared as follows.

When titanium oxide particle is employed as the N-type semiconductor particle, aqueous slurry is prepared by dispersing titanium oxide particles having a number average primary particle diameter of 50 nm in a concentration of from 50 to 350 g/L, and a water-soluble silicate or a water-soluble aluminum compound is added to the slurry. After that, the slurry is neutralized by adding an alkali or an acid so as to precipitate silica or alumina onto the surface of the titanium oxide particles. And then the particles are filtered, washed and dried for obtaining the objective surface-treated titanium oxide. When sodium silicate is employed as the water-soluble silicate, the neutralization can be carried out by an acid such as sulfuric acid, nitric acid hydrochloric acid. When aluminum sulfate is employed as the water-soluble aluminum. compound, the neutralization can be performed by an alkali such as sodium hydroxide and potassium hydroxide.

An intermediate layer coating liquid prepared for forming the intermediate layer employed in the invention is constituted by a binder and a dispersing solvent additional to the surface-treated N-type semiconductor particles.

The ratio of the N-type semiconductor particles to the binder resin in the intermediate layer is preferably from 1.0 to 2.0 times of the binder resin in the volume ratio. By employing the N-type semiconductor particles in such the high density in the intermediate layer, a rectifying ability of the intermediate layer is increased so that the increasing of the remaining potential and the transfer memory are not caused even when the thickness of the layer is increased, the black spots can be effectively prevented and the suitable organic photoconductor with small potential fluctuation can be prepared. In the intermediate layer, 100 to 200 parts by volume of the N-type semiconductor particles are preferably employed to 100 parts by volume the binder resin.

As the binder for dispersing the particles and forming the interlayer, polyamide resins are preferable for obtaining good dispersing state, the following polyamide resins are particularly preferred.

Polyamide resins each having a heat of fusion of from 0 to 40 J/g and a water absorption degree of not more than 5% are preferable for the binder of the interlayer. The heat of fusion of the resin is preferably from 0 to 30 J/g, and most preferably from 0 to 20 J/g. By such the polyamide resins, the moisture content is suitably kept, and the occurrence of the dielectric breakdown and the black spot, increasing of the remaining potential and the formation of fog are inhibited. Accordingly, the water absorption degree is more preferably not more than 4% by mass.

The heat of fusion of the resin is measured by differential scanning calorimetry (DSC). Another method may be utilized as long as a result the same as that obtained by DSC can be obtained. The heat of fusion is obtained from the area of endothermic peak in the course of temperature rising in the DSC measurement.

The water absorption degree of the resin is measured by, the weight variation by a water immersion method or Carl-Fischer's method.

As the binder resin of the interlayer, a resin superior in the solubility in solvent is necessary for forming the interlayer having a uniform layer thickness. Alcohol-soluble polyamide resins are preferable for the binder resin of the interlayer. As such the alcohol-soluble polyamide resin, copolymerized polyamide resins having a short carbon chain between the amide bond such as 6-Nylon and methoxymethylized polyamide resins have been known. These resins have high water absorption degree, and the interlayer employing such the polyamide tends to have high dependency on the environmental condition. Consequently, the sensitivity and the charge property are easily varied under high temperature and high humidity or low temperature and low humidity condition, and the dielectric breakdown and the black spots occur easily.

In the invention, the alcohol-soluble polyamide resins having a heat of fusion of from 0 to 40 J/g and a water absorption degree of not more than 5% by weight are employed to improve such the shortcoming of the usual alcohol-soluble polyamide resin. Thus good electrophotographic image can be obtained even when the exterior environmental conditions are changed and the electrophotographic photoconductor is continuously used for a prolonged period.

The alcohol-soluble polyamide resin having a heat of fusion of from 0 to 40 J/g and a water absorption degree of not more than 5% by weight is described below.

It is preferable that the alcohol-soluble polyamide resins contains structural repeating units each having a number of carbon atoms between the amide bonding of from 7 to 30 in a ratio of from 40 to 100 Mole-% of the entire repeating units.

The repeating unit means an amide bonding unit constituting the polyamide resin. Such the matter is described below referring the an examples of polyamide resin (Type A) in which the repeating unit is formed by condensation of compounds each having both of an amino group and a carboxylic acid group and examples of the polyamide resin (Type B) in which the repeating unit is formed by condensation of a diamino compound and a di-carboxylic acid compound.

The repeating unit structure of Type A is represented by Formula 5, in which the number of carbon atoms included in X is the carbon number of the amide bond unit in the repeating unit. The repeating unit structure of Type B is represented by Formula 6, in which both of the number of carbon atoms included in Y and that included in Z are each the number of carbon atoms of the amide bond in the repeating unit structure.

Formula 2

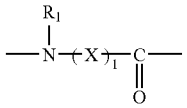

In the above, $R_1$ is a hydrogen atom or a substituted or unsubstituted alkyl group; X is an alkylene group, a group containing di-valent cycloalkane group or a group having mixed structure of the above; the above groups represented by X may have a substituent; and 1 is a natural number.

Formula 3

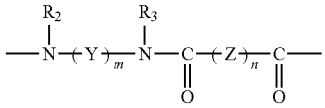

$R_2$ and $R_3$ are each a hydrogen atom, a substituted or unsubstituted alkyl group; Y and Z are each an alkylene group, a group containing a di-valent cycloalkane group or a group having mixed structure of the above, the above groups represented by Y and Z each may have a substituent; and m and n are each a natural number.

Examples of the structure of repeating unit having carbon atoms of from 7 to 30 are a substituted or unsubstituted alkylene group, an alkylene group, a group containing a di-valent cycloalkane group or a group having mixed structure of the above, and the above groups represented by Y and Z each may have a substituent. Among them the structures having the di-valent cycloalkane groups are preferred.

In the polyamide resin to be used in the invention, the number of the carbon atoms between the amide bonds of the repeating unit structure is from 7 to 30 for inhibiting the hygroscopic property of the polyamide resin so that the photographic properties, particularly the humidity dependency of the potential on the occasion of the repeating use is made small and the occurrence of the image defects such as the black spots is inhibited without lowering of the solubility of the resin in the solvent for coating.

The carbon number is preferably from 9 to 25, more preferably from 11 to 20. The ratio of the structural repeating unit having from 7 to 30 between the amide bonds to the entire repeating units is from 40 to 100 mole-percent, preferably from 60 to 100 mole-percent, and further preferably from 80 to 100 mole-percent.

Number of carbon atoms of polyamide is preferably 7-30, since such polyamide has adequate hygroscopicity and good solubility in solvent for coating composition.

Polyamide resins having a repeating unit structure represented by Formula 7 are preferred.

Formula 4

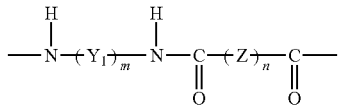

In the above, $Y_1$ is a di-valent group containing an alkyl-substituted cycloalkane group, $Z_1$ is a methylene group, m is an integer of from 1 to 3 and n is an integer of 3 to 20.

The polyamide resins in which the group represented by $Y_1$ is the group represented by the following formula are preferable since such the polyamide resins display considerable improving effect on the black spot occurrence.

Formula 7

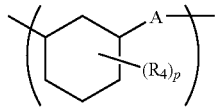

In the above, A is a simple bond or an alkylene group having from 1 to 4 carbon atoms; $R_4$ is an alkyl group; and p is a natural number of from 1 to 5. Plural $R_4$ may be the same as or different from each other.

Concrete examples of the polyamide resin are shown below.

N-1

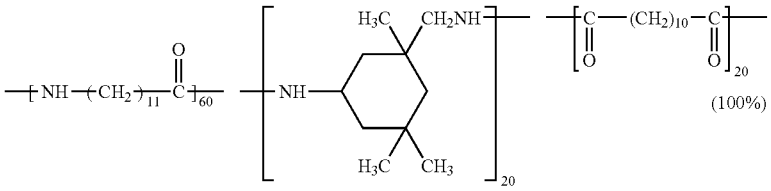

(100%)

N-2

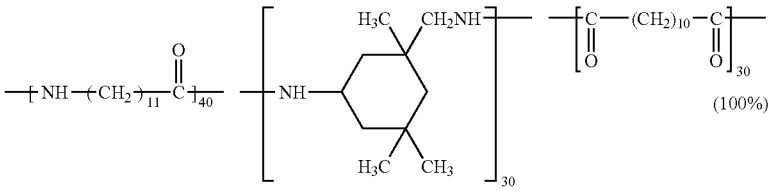

(100%)

N-3

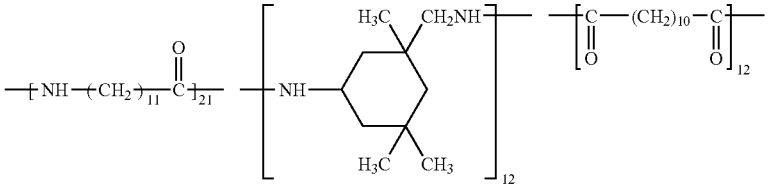

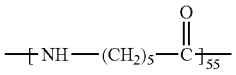

(45%)

-continued
N-4
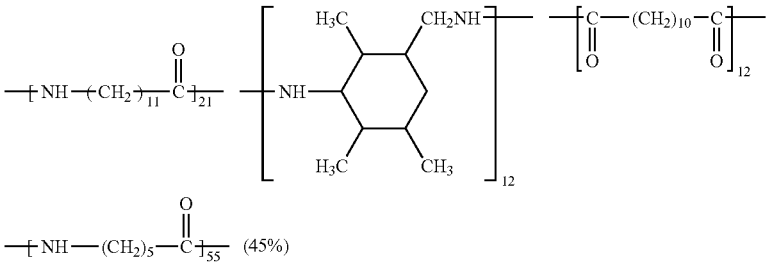
N-5
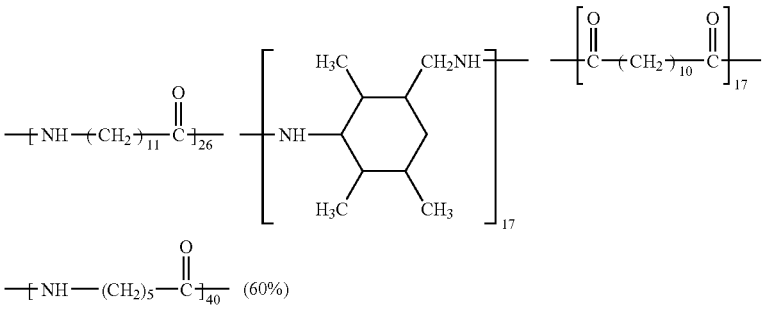
N-6
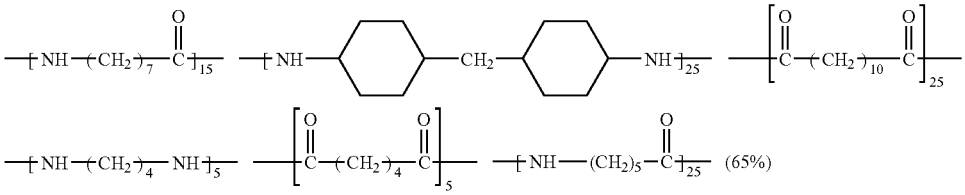
N-7
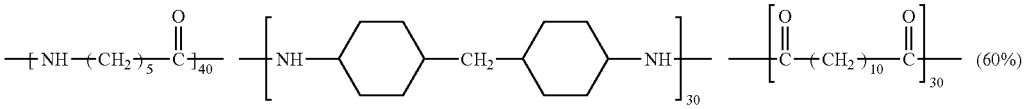
N-8
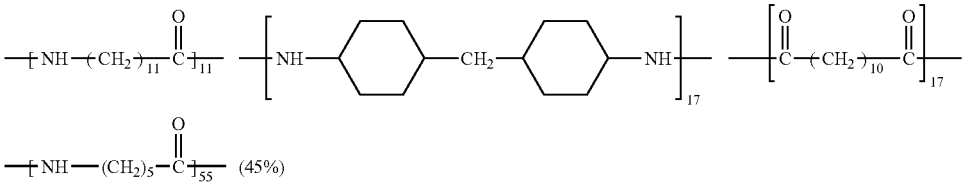
N-9
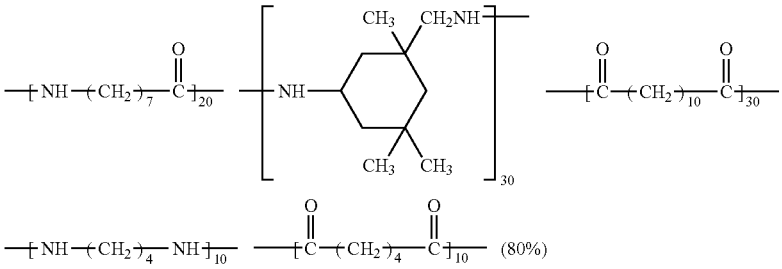
N-10
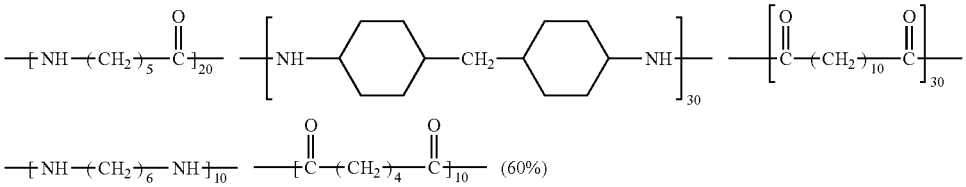

-continued

N-11

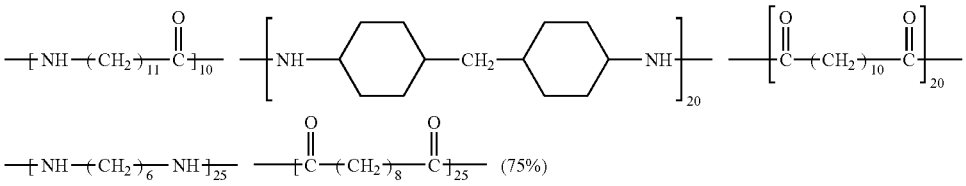

In the above concrete examples, percentage shown in the parentheses represents the ratio in terms of mole-% of the repeating units having the 7 or more atoms between the amide bonds.

Among the above examples, the polyamide resins of N-1 through N-4 having the repeating unit represented by Formula 7 are particularly preferred.

The molecular weight of the polyamide resins is preferably from 5,000 to 80,000, more preferably from 10,000 to 60,000, in terms of number average molecular weight, because the uniformity of the thickness of the coated layer is satisfactory and the effects of the invention are sufficiently realized, and the solubility of the resin in the solvent is suitable, formation the coagulates of the resin in the interlayer and the occurrence of the image defects such as the black spots are inhibited.

The polyamide resin, for example, VESTAMELT X1010 and X4685, manufactured by Daicel•Degussa Ltd., are available in the market, and it is easy to prepare in a usual method. An example of the synthesis method is described.

Synthesis of Exemplified Polyamide Resin N-1

In a polymerization kettle, to which a stirrer, nitrogen, a nitrogen gas introducing pipe, a thermometer and a dehydration tube were attached, 215 parts by mass of lauryllactam, 112 parts by mass of 3-aminomethyl-3,5,5-trimethylcyclohexylamine, 153 parts by mass of 1,12-dodecane dicarboxylic acid and 2 parts by mass of water were mixed and reacted for 9 hours while applying heat and pressure and removing water by distillation. The resultant polymer was taken out and the composition of the copolymer was determined by $C^{13}$—NMR, the composition of the polymer agreed with that of N-11. The melt flow index (MFI) of the above-synthesized copolymer was 5 g/10 min under the condition of 230° C./2.16 kg.

As the solvent for preparing the coating liquid, alcohols having 2 through 4 carbon atoms such as ethanol, n-propyl alcohol, iso-propyl alcohol, n-butanol, t-butanol and sec-butanol are preferable from the viewpoint of the solubility of the polyamide resin and the coating suitability of the prepared coating liquid. These solvents are employed in a ratio of from 30 to 100%, preferably from 40 to 100%, and further preferably from 50 to 100%, by weight of the entire solvent amount. As solvent aid giving preferable effects when it is used together with the foregoing solvents, methanol, benzyl alcohol, toluene, methylene chloride, cyclohexanone and tetrahydrofuran are preferable.

Thickness of the interlayer is preferably 0.3-10 μm, and more preferably 0.5-5 μm, in view of minimized generation of black spots and non-uniform image at half tone area, inhibiting increase of residual potential and generation of transfer memory, whereby good image having high sharpness can be obtained.

The interlayer is substantially an insulation layer. The volume resistivity of the insulation layer is not less than $1\times10^8$ Ω·cm. The volume resistivity of the interlayer and the protective layer is preferably from $1\times10^8$ to $1\times10^{15}$ Ω·cm, more preferably from $1\times10^9$ to $1\times10^{14}$ Ω·cm, and further preferably from $2\times10^9$ to $1\times10^{13}$ Ω·cm. The volume resistivity can be measured as follows.

Measuring condition: According to JIS C2318-1975

Measuring apparatus: Hiresta IP manufactured by Mitsubishi Chemical Corporation.

Measuring condition: Measuring prove HRS

Applied voltage: 500 V

Measuring environment: 30±2° C., 80±5% RH

Photosensitive Layer

The photosensitive layer preferably has a structure in which the functions of the photosensitive layer are separated into a charge generation layer (CGL) and a charge transfer layer (CTL) provided on the intermediate layer, even though the photosensitive layer constituted by a single layer structure having both of the charge generation function and the charge transfer function may be applied. By the function separated structure, the increasing of the remaining potential accompanied with repeating use can be inhibited and the other electrophotographic properties can be easily controlled for fitting to the purpose. In the negatively charging photoconductor, the structure in which the charge generation layer (CGL) is provided on the intermediate layer, and the charge transfer layer (CTL) is further provided on the charge generation layer.

The composition of the photosensitive layer of the negatively charging function separated photoconductor is described below.

Charge Generation Layer

The charge generation layer contains a charge generation material (CGM). Other than that, a binder resin and another additive may be contained.

For the gallium-phthalocyanine pigment, chlorogallium-phthalocyanine pigment at least displaying characteristic diffraction peaks at 7.4°, 16.6°, 25.5° and 28.3°, hydroxygallium-phthalocyanine pigment at least displaying characteristic diffraction peaks at 7.5°, 9.9°, 12.5°, 16.3°, 18.6°, 25.1° and 28.1°, and gallium-phthalocyanine pigment at least displaying characteristic diffraction peaks at 6.8°, 12.8°, 15.8° and 26.6° in Bragg angle (2θ±0.2°) in the Cu-Kα characteristic X-ray diffraction spectrum are preferable. By combining the charge generation layer containing gallium-phthalocyanine pigment displaying such the X-ray diffraction spectrum with the charge transfer layer, a photoconductor having high sensitivity can be obtained by which a suitable electrophotographic image can be formed which is improved in the occurrence of the unevenness and the burring of image caused by the dash marks and the scratches and in the transfer memory.

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably binder resin 100 weight part for charge generating material 20 to 600 weight part. Increase in residual electric potential with repeated use can be minimized by using these resins. The layer thickness of the charge generating layer is preferably in the range of 0.3 to 2 mm.

Charge Transporting Layer

As described above, the structure which constitutes the charge transporting layer from plural charge transporting layers and make a charge transporting layer of the top layer contain fluorine based resin particles is preferable.

A charge transporting layer contains a charge transporting material (CTM) and a binder resin for dispersing the CTM and forming a layer. In addition to the fluorine based resin particles, the charge transporting layer may contain additives such as an antioxidant agent if necessary.

As a charge transporting material (CTM), a known charge transporting material (CTM) of the positive hole transportation type (P type) can be used. For example, triphenylamines, hydrazones, styryl compound, benzidine compound, butadiene compound can be applied. These charge transporting materials are usually dissolved in a proper binder resin to form a layer.

As the binder resin for charge transporting layer (CTL), any one of thermoplastic resin and thermosetting resin may be used. For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resin, high polymer organic semiconductor such as poly-N-vinyl carbazole may be usable. The most preferred material is polycarbonate resin in view of, smaller water absorbing rate, dispersing ability of the CTM and electro photosensitive characteristics.

Ratio of the binder resin is preferably 50 to 200 parts by mass to 100 parts of charge transporting material by weight. Total thickness of the CTL is preferably 10-40 μm. CTL which is positioned at the surface layer is preferably 0.5-10 μm.

Moreover, it is preferable to make the surface layer containing the fluorine-containing resin particles contain an antioxidant. Although the surface layer containing a fluorine-containing resin particles tends to oxidize with activated gas at the time of charging of a photoconductor, for example, NOx, ozone, etc., and easily generates a blur image, the occurrence of a blur image can be prevented by making an antioxidant exist together with it. Here, as an added amount of the antioxidant, 0.1 parts to 50 parts is to 100 parts of binders in the surface phase, preferably 0.5 parts to 25 parts. The antioxidant is a material, as a typical one, having a character to prevent or control an action of oxygen under conditions, such as light, heat, and electric discharge, to an auto-oxidizing substance which exists in an organic photoconductor or on the surface of an organic photoconductor. Typically, the following compound groups are listed.

1-1

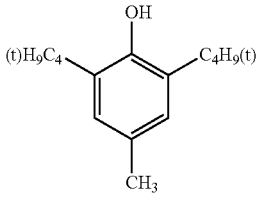

1-2

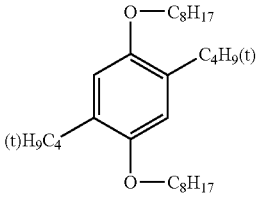

1-3

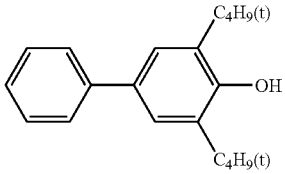

1-4

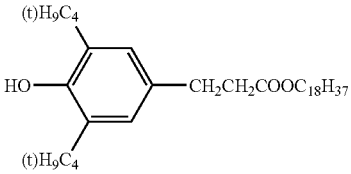

1-5

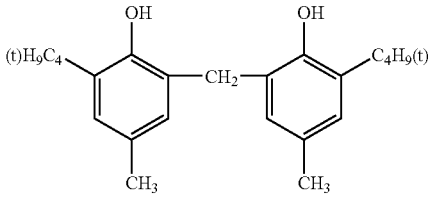

1-6

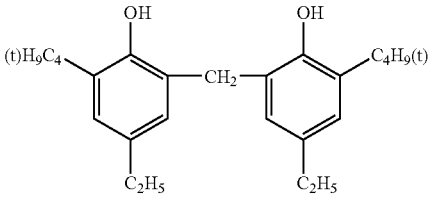

1-7

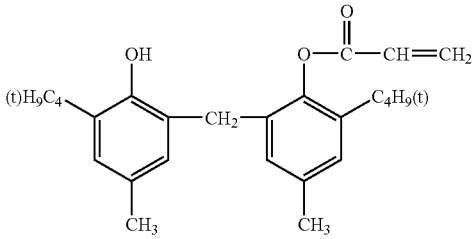

1-8

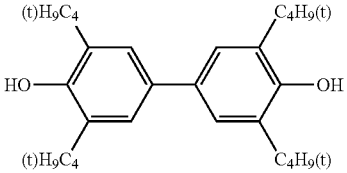

-continued
1-9
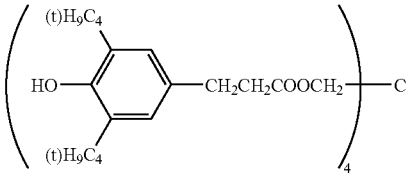
1-10
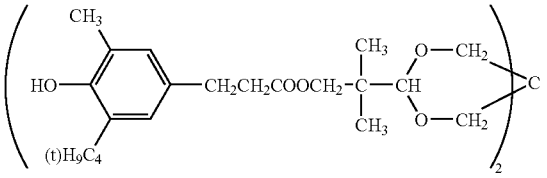
1-11
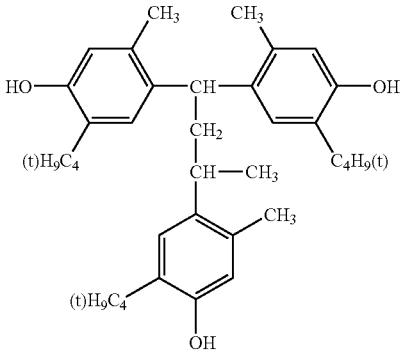
2-1
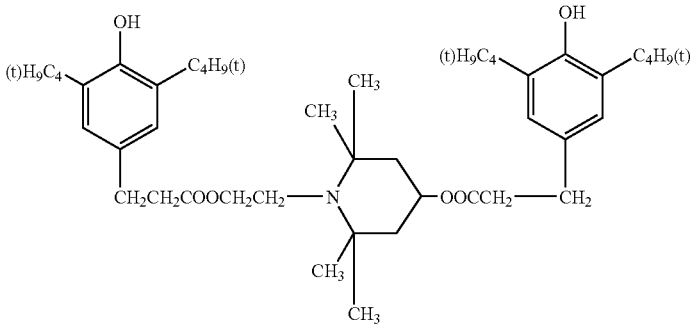
2-2
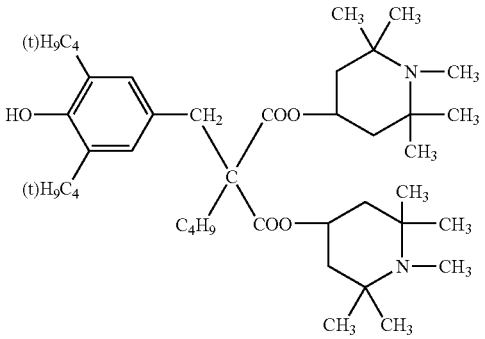
2-3
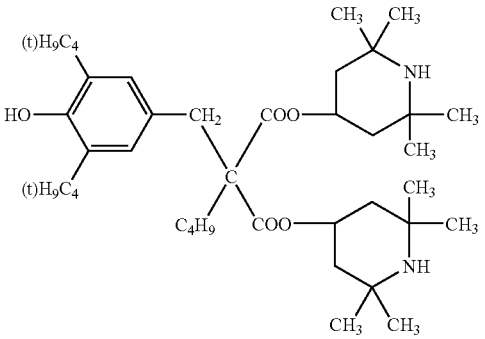
2-4
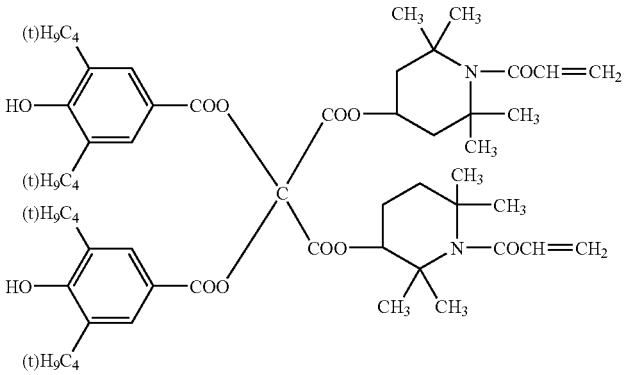

-continued 2-5

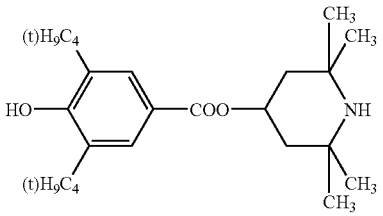

2-6

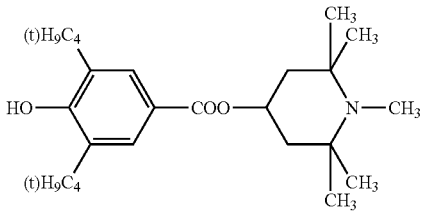

2-7

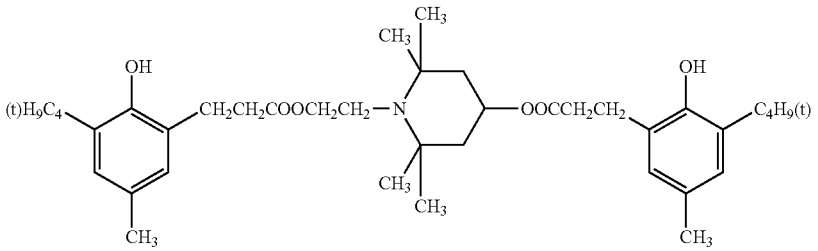

As a solvent or a dispersion medium used for forming an intermediate layer, a photosensitive layer and a protective layer, n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve may be listed. The present invention is not restricted to these one, dichloromethane, 1,2-dichloro ethane and methyl ethyl ketone are used preferably. Further, these solvents or dispersion media may also be used either independently or as mixed solvents of two or more types.

Next, an image forming apparatus employing the organic photoconductor of the invention will be explained.

Figure 3:
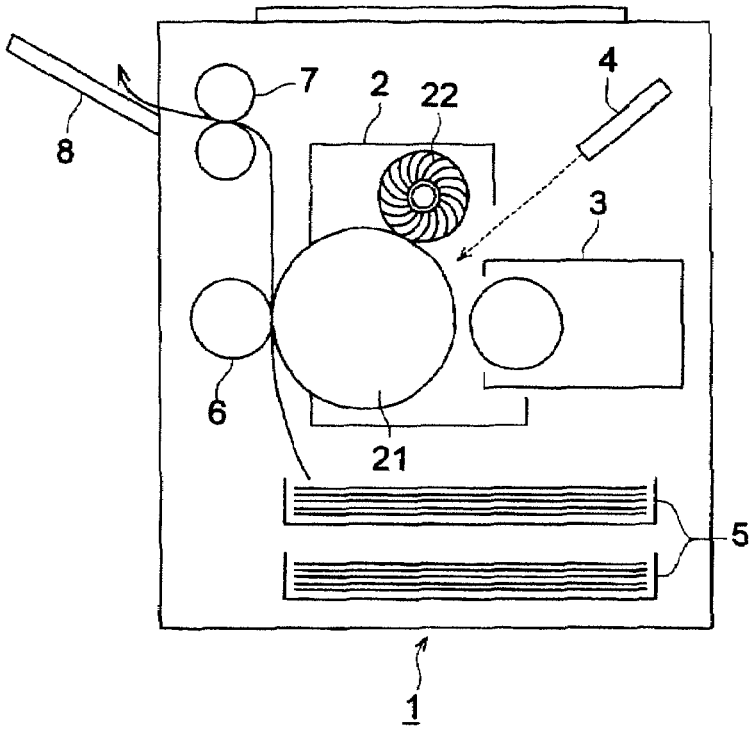
FIG. 3 is a sectional schematic view of an image forming apparatus employing a contact charging system relating to the invention.

FIG. 3 is a sectional schematic view of image forming apparatus 1 employing a contact charging system relating to the invention. The image forming apparatus 1 has therein photoconductor cartridge 2, developing cartridge 3, exposure unit 4 that emits a laser beam modulated based on image signals coming from the outside, while deflecting the laser beam, sheet feeding unit 5 that feeds a recording sheet, transfer roller 6, fixing unit 7 and sheet ejection tray 8.

The photoconductor cartridge 2 is provided therein with photoconductor 21 that is made by forming a thin film layer of organic photoconductive material on an outer circumferential surface of a cylindrical body, and with charging brush 22. The developing cartridge 3 is provided therein with an unillustrated developing sleeve, a stirring roller, and with a toner tank wherein toner and carrier are housed, and developing bias is impressed on the developing sleeve from an unillustrated developing power supply.

For preventing generation of troubles caused by mechanical contact in the case of mounting cartridges on or removing them from the image forming apparatus 1, each of both cartridges is provided with an unillustrated protective cover that is closed in the case of insertion into the image forming apparatus 1 and is opened in the case of removing from the image forming apparatus 1.

In FIG. 3, the photoconductor cartridge 2 and the developing cartridge 3 are illustrated. However, it is possible to structure a process cartridge such that process cartridge comprises a supporting member to support in one body at least one of an organic photoconductor, a charging device, a latent image forming device, a developing device, a transferring device and a charge eliminating device and the process cartridge is adapted to be mounted or dismounted freely on the image forming apparatus.

Since the image forming process is widely known, it will be shown simply as follows. First, a surface of the photoconductor 21 is charged evenly with prescribed voltage by the charging brush 22. The exposure unit 4 generates modulated laser beam (that is shown with an arrow of a broken line), then, this laser beam is deflected by an unillustrated polygon mirror for deflection scanning on the photoconductor 21, thus, electrostatic latent images corresponding to image information are formed on the charged surface in succession.

When forming an electrostatic latent image on a photoconductor in the image forming apparatus of the invention, it is preferable to form a dot latent image by using a semiconductor laser or a light-emitting diode as a light source for exposure. By conducting digital exposure on the organic photoconductor by closing down a spot diameter (spot diameter of exposure beam) for image-wise exposure to 80 nm or less, preferably to 60 nm or less and to 15 nm or more by using a light source for image-wise exposure, it is possible to obtain electrophotographic images at high resolution ranging from 400 dpi (dpi: number of dots per 2.54 cm) or more to 2400 dpi.

The spot diameter of the exposure beam is assumed to be a diameter of true circle that is converted from an area where the intensity of the exposure beam corresponds to light intensity that is $1/e^2$ times or more the peak intensity.

Incidentally, toner housed in the toner tank is supplied onto the developing sleeve after being stirred by the stirring roller, and forms a toner image corresponding to the electrostatic latent image at a portion facing the photoconductor 21. Simultaneously, residual toner remaining on the unexposed portion (non-image portion) on the surface of photoconductor 21 is collected in the developing cartridge, by using the voltage difference between developing bias voltage to be impressed on the developing sleeve and surface voltage of the photoconductor 21. On the other hand, a toner image is transferred onto a recording sheet on an electrostatic basis by the transfer roller 6 arrange to face the photoconductor 21. Incidentally, a recording sheet is brought from the sheet feeding unit 5 along a conveyance path shown with an arrow of solid line in the drawing. Then, this recording sheet is conveyed to the fixing unit 7 where unfixed toner image is fixed on the recording sheet through heat fixing. Finally, the recording sheet on which aimed images are formed is ejected to sheet ejection tray 8. Thus, many duplicates of a document can be made at high speed, by repeating the aforementioned series of process.

The charging brush stirs mechanically residual toner. conveyed by rotation of the photoconductor to the contact portion between the photoconductor and the charging brush, and diffuses it on the surface of the photoconductor until the moment when the residual toner becomes unreadable. Further, the charging brush absorbs residual toner having polarity opposite to that of electrification polarity of the photoconductor (reverse polarity) on an electrostatic basis, to collect it, and charges it to be of the same polarity (regular polarity) as the electrification polarity of the photoconductor to discharge on the photoconductor surface.

The image forming apparatus 1 employs a leaner-less system (cleaner-less process) wherein the residual toner on the photoconductor is collected finally by the developing sleeve, and the organic photoconductor from which the toner image has been transferred is made to circulate to the charging means to form electrophotographic images repeatedly, without attaching to a cleaning means that comes in contact with a surface of the organic photoconductor. If the organic photoconductor of the invention is applied on an image forming apparatus employing both a contact charging method and a cleaner-less process, an effect of the invention tends to appear more remarkably.

Figure 4:
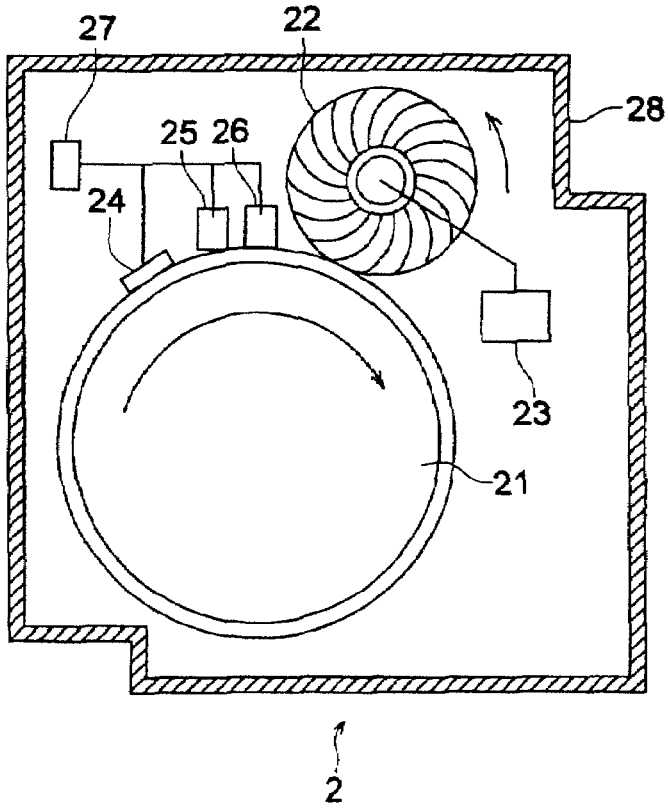
FIG. 4 is a sectional schematic view of a photoconductor cartridge that can be mounted on or removed from an image forming apparatus freely.

FIG. 4 is a sectional schematic view of photoconductor cartridge 2 that can be mounted on or removed from image forming apparatus 1 freely. In casing 28 with a protective cover of the photoconductor cartridge 2, there are provided photoconductor 21 representing an image carrier, charging brush 22 arranged around the photoconductor 21 to be in contact therewith, power supply connection member 23 for impressing prescribed voltage on the charging brush 22, pre-charging film 24, charging shakedown members (sponge-shaped charging members) 25 and 26 and power supply connection member 27.

The photoconductor 21 is rotated by an unillustrated driving apparatus in the direction of an arrow in the drawing. The charging brush 22 is one wherein conductive bristles composed of capillary fibers are flocked on a brush support. This charging brush 22 is rotated by an unillustrated drive apparatus in the direction of an arrow in the drawing, under the condition that the charging brush is in contact with the surface of the photoconductor 21, namely, it is rotated in the same direction as that of the photoconductor 21 in the portion of contact between the photoconductor 21 and the charging brush 22. In the course of image forming, voltage is impressed on the charging brush 22 from an unillustrated power supply, whereby, the surface of the photoconductor 21 is charged evenly to be in the prescribed polarity. On the other hand, in the course of non-image forming, voltage having polarity that is opposite to that in the image forming is impressed on the charging brush 22 from s power supply for charging. Incidentally, charged polarity of toner is the same as polarity of charging voltage in the image forming. Therefore, toner accumulated in the charging brush 22 in the course of non-image forming can be discharged on the photoconductor 21 by electrostatic repelling power.

Development-pre-charging film 24 and charging shakedown members 25 and 26 are arranged to make up for charging unevenness caused by charging brush 22.

Further, in the image forming apparatus of the invention, it is preferable to use polymerization toner for a developer used for the developing means. By using polymerization toner having uniform forms and particle size distribution together with the organic photoconductor of the invention, electrophotographic images having better sharpness can be obtained.

The polymerization toner in this case means toner obtained after binder resin for toner is generated, and after material monomer for binder resin is polymerized and formed by chemical processing thereafter. More specifically, the polymerization toner means toner obtained through polymerization reaction such as suspension polymerization and emulsion polymerization, and through, in case of need, a fusing process conducted thereafter.

In the case of polymerization toner, material monomer is uniformly dispersed in an aqueous system and polymerization is conducted to manufacture the toner. Therefore, toner whose particle size distribution and forms are uniform can be obtained.

The polymerization toner can be manufactured through a method wherein suspension polymerization is conducted, and emulsion polymerization is conducted for monomer in the solution to which emulsification solution of necessary addition agents is added, to manufacture fine polymerization particles, and then, an organic solvent and coagulant are added for association. In the case of the association, there are given a method to adjust through the association by mixing with dispersions of releasing agents and coloring agents which are necessary for constituting toner, and a method for conducting emulsion polymerization after dispersing toner constituting components such as releasing agents and coloring agents in the monomer. The association in this case means an occasion where a plurality of resin particles and a plurality of coloring agent particles are fused.

Namely, various types of constituting materials such as coloring agents, and, if necessary, releasing agents, charge control agents, and further, polymerization starter are added to polymerizable monomer, and a homogenizer, a sand mill, a sand grinder or an ultrasonic homogenizer is used to make various constituting materials to be dissolved or dispersed in the polymerizable monomer. This polymerizable monomer wherein various constituting materials are dissolved or dispersed is dispersed in a water type medium containing dispersion stabilizers, by using a homomixer or a homogenizer so that an oil drop may become to be in a desired size After that, the polymerizable monomer is moved to a reaction vessel wherein a stirring mechanism is a stirring blade that is described later, and is heated to advance polymerization reaction. After completion of the reaction, the dispersion stabilizers are removed, thus, toner is prepared through filtration, washing and drying.

As a method to manufacture toner of the invention, there are given a method to manufacture toner by associating resin particles in a water type medium and a method to manufacture toner by fused resin particles in a water type medium. As this method, there is no restriction, in particular, and there are given methods disclosed, for example, in TOKKAIHEI Nos. 5-265252, 6-329947 and 9-15904. Namely, it is possible to form toner by the method to associate a plurality of resin particles and dispersed particles of components such as coloring agents or fine particles composed of resins and coloring agents, in particular, by adding coagulants with critical aggregation density or more for salting out after dispersing these in water by using emulsifiers, and simultaneously, by heating and fusing at the glass transition point or higher to grow particles gradually while forming fused particles, then, by adding a large amount of water when an aimed particle size is obtained to stop the growth of particle size, and further, by making a surface of a particle to be smooth and by controlling its form while heating and stirring, and finally, by heating and drying these particles under the state of wet type and under the fluid state.

Incidentally, materials, manufacturing methods and reaction vessels for polymerization toner for manufacturing toner that is used in the invention and has uniform form coefficient are described fully in TOKKAI No. 2000-214629.

Figure 5:
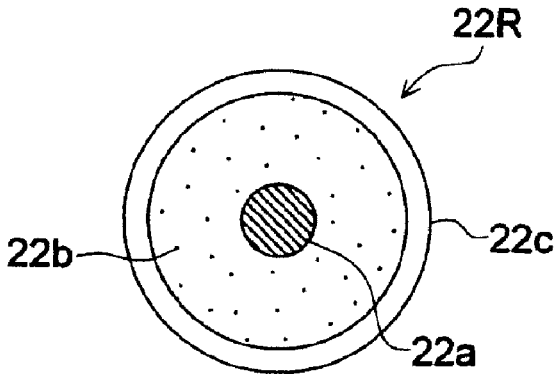
FIG. 5 is a sectional view showing the structure of a charging roller.

A charging roller may also be used in place of the charging brush in FIGS. 3 and 4 above. FIG. 5 is a sectional view showing the structure of a charging roller.

As shown in FIG. 5, the charging roller 22R is composed of core metal 22*a* and of rubber layer such as chloroprene rubber, urethane rubber or silicone rubber or their sponge layer 22*b*, and preferably, protective layer 22*c* composed of a releasing fluorine-based resin layer or a silicone resin layer having a thickness of 0.01-1 μm is provided on the outermost layer.

It is preferable that the charging roller is brought into contact with the photoconductor 21 by pressing force of 10-100 g/cm. It is further preferable that a peripheral speed of the charging roller is 1-8 times the peripheral speed of the photoconductor drum 21.

Incidentally, though the monochromatic laser printer of a contact charging method is shown in the image forming apparatus stated above, a laser printer of a non-contact type also gives the same effect as a charging means. Further, it can also be applied to a color laser printer and to a color copying machine. Further, a light source other than a laser, for example, an LED light source may also be used as an exposure light source.

Figure 6:
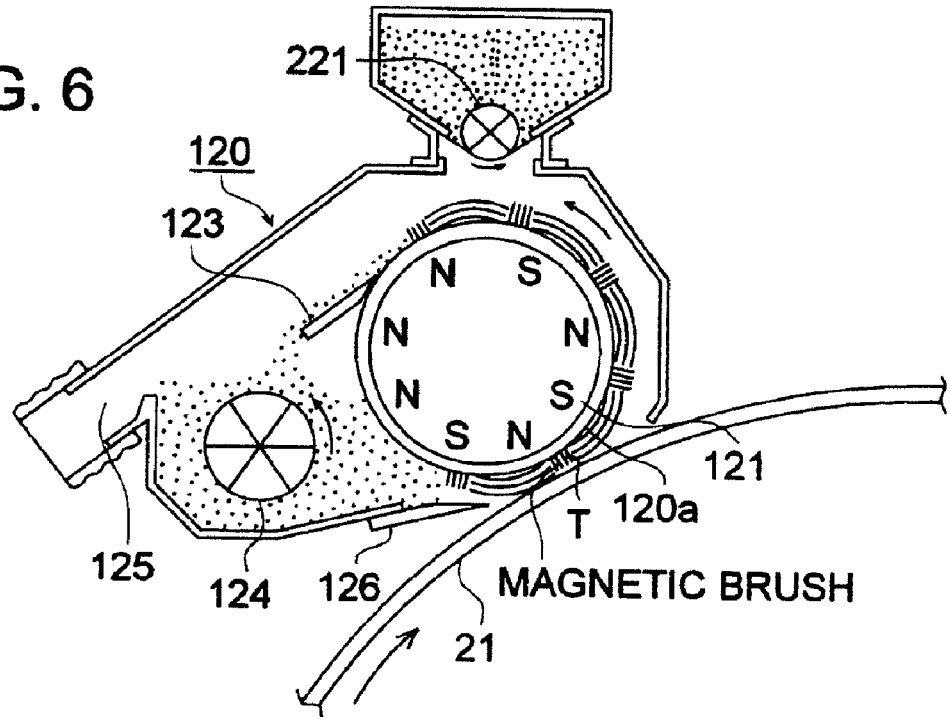
FIG. 6 is a diagram showing an example of a section of a magnetic brush charging unit.

A magnetic brush charging unit may also be used in place of a charging brush in each of the FIG. 3 and FIG. 4. FIG. 6 is a diagram showing an example of a section of the magnetic brush charging unit.

In FIG. 6, the numeral 120 represents a magnetic brush charging unit, 21 represents a photoconductor drum, T represents a charging section, 120*a* represents a charging sleeve, 121 represents a magnet body, 123 represents a scraper and 124 represents a stirring screw.

In FIG. 6, the magnetic brush charging unit 120 is composed of cylindrical charging sleeve 120*a* made of, for example, aluminum or stainless steel that faces rotating photoconductor drum 21, and represents a magnetic particle conveying member for charging rotated at the portion of contact with photoconductor drum 21 (charging portion T) in the same direction (counterclockwise direction), magnetic body 121 that is provided in the charging sleeve 120*a* and is composed of N pole and S pole, a magnetic brush composed of magnetic particles that is formed on an outer circumferential surface of the charging sleeve 120*a* and charges photoconductor drum 21, scraper 123 that scrapes magnetic brush on the charging sleeve 120*a* at N-N magnetic pole section of the magnetic body 121, stirring screw 124 that stirs magnetic particles in the magnetic brush charging unit 120, or discharges used magnetic particles from an outlet 125 of the magnetic brush charging unit 120 when supplying magnetic particles, and of bristle height regulating plate 126 for the magnetic brush. It is preferable that the charging sleeve 120*a* is arranged to be capable of rotating around the magnetic body 121, and is rotated at the peripheral speed that is 0.1-1.0 times the peripheral speed of the photoconductor drum 21 in the same direction (counterclockwise direction) as the direction of movement of the photoconductor drum 21 at the position where the charging sleeve 120*a* faces the photoconductor drum 21. Though a conductive conveyance carrier capable of being impressed by charging bias voltage is used as the charging sleeve 120*a*, the one having the structure wherein magnetic body 121 having a plurality of magnetic poles is provided in conductive charging sleeve 120*a* on which a layer of particles is formed is preferably used in particular. In the conveyance carrier of this kind, a layer of magnetic particles formed on the surface of the conductive charging sleeve 120*a* is moved in a wavy form by the relative rotation for the magnetic body 121, and therefore, fresh magnetic particles are supplied in succession, and even when a thickness of a layer of magnetic particles on the surface the charging sleeve 120*a* is not uniform, an influence thereof is fully covered by the aforesaid wavy corrugation, so that the unevenness of the layer thickness may not be actual problems. It is preferable that the average roughness of the surface of the charging sleeve 120*a* is made to be 5.0-30 μm for stable uniform conveyance of magnetic particles. If the surface is smooth, magnetic particles are not conveyed sufficiently, while, when the surface is too rough, excess current flows from heights, which means that charging unevenness tends to be caused in both cases. To obtain the surface roughness stated above, sand-blast processing is preferably used. An outside diameter of the charging sleeve 120*a* is preferably in a range of 5.0-20 mm. Owing to this, a contact area necessary for charging is secured. If the contact area is large more than necessary, charging current becomes excessive, while, if it is small, charging unevenness is easily caused. When a small diameter is taken as stated above, centrifugal force causes magnetic particles to scatter or adhere to photoconductor drum 21 easily, therefore, it is preferable that the linear speed of the charging sleeve 120*a* is substantially the same as the traveling speed of the photoconductive drum 21 or lower than that.

It is further preferable that a thickness of the layer of magnetic particles formed on the charging sleeve 120*a* is one that is scraped away sufficiently by a regulating means to become a uniform layer. If an amount of magnetic particles present on the surface of the charging sleeve 120*a* is too large at the charging area, the magnetic particles are not vibrated sufficiently, causing abrasion of the photoconductor and charging unevenness, resulting in defects that excess current tends to flow and driving torque for the charging sleeve 120*a* grows greater. If an amount of magnetic particles present on the surface of the charging sleeve 120*a* is too small at the charging area, on the contrary, an imperfect portion for contact with photoconductor drum 21 is caused, resulting in adhesion of magnetic particles on photoconductor drum 21 and charging unevenness. After repeated experiments, it has been cleared that a preferable amount of adhesion of magnetic particles at the charging area is 100-400 mg/cm$^2$, and an especially preferable amount is 200-300 mg/cm$^2$. Incidentally, this amount of adhesion is a mean value at the charging area of the magnetic brush.

In the invention, a coating solution wherein fluorine-containing fine particles are dispersed is coated in a profitable way by using a circular slide hopper type coating apparatus. In an example of the circular slide hopper type coating apparatus, cylindrical base materials 251A and 251B connected vertically along center line XX are lifted continuously in the direction of an arrow as shown on a longitudinal sectional view in FIG. 1, for example, portion (which is simply called a coating head) 260 that is directly related to coating of the slide hopper type coating apparatus that surrounds the base material coats coating solution L on an outer circumferential surface of the base material 251. Incidentally, the base material may also be a base material of a seamless belt type, in addition to a hollow drum such as an aluminum drum and a plastic drum. AS shown in FIG. 2, on the coating head 260, there is formed narrow coating solution distributing slit (which is called a slit simply) having coating solution outlet 261 that is opened to the base material 251 side, in the horizontal direction. The slit 262 is communicated with annular coating solution distributing chamber 263, and coating solution L in reservoir tank 254 is supplied to this annular coating solution distributing chamber 263 through supply tube 264 by pressure pump 255. On the other hand, on the lower side of the coating solution outlet 261 of the slit 262, there is formed slide surface 265 which is inclined downward continuously and is formed to be a terminal end whose dimension is slightly greater than the outer dimension of the base material. Further, there is formed lip portion (bead: solution pool) 266 that extends downward from the terminal end of the slide surface 265. In coating conducted by the coating apparatus of this kind, coating solution L is extruded from the slit 262 in the course of lifting the base material 251, when the coating solution flows down along the slide surface 265, a photosensitive solution which has arrived at the terminal end of the slide surface forms a bead between the terminal end of the slide surface and an outer circumferential surface of the base material 251, and then, is coated on the surface of the base material. Excessive photosensitive solutions are ejected from ejection section 267.

EXAMPLES

Although examples are given and this invention is hereafter explained to details, the aspect of this invention is not limited to this. Incidentally, "part" in the following sentences represents "parts by mass".

Manufacture of Photoconductor 1-1

<Intermediate Layer>

The cylinder type aluminum base support, which surface has 10 points surface roughness Rz of 0.81 μm measured according to regulation of JISB-0601 by subjecting to cutting process and washed, was subjected to coating with the following interlayer coating composition by dipping and thereafter drying at 120 c. degree for 30 minutes, an interlayer having dry thickness of 1.0 μm was prepared.

The following intermediate layer dispersion liquid was diluted twice with the same mixed solvent, and filtered after settling for overnight (filter; Nihon Pall Ltd. company make RIGIMESH 5 μm filter, pressure at 50 kPa), whereby the intermediate layer coating solution was produced.

| (Preparation of intermediate layer dispersion) | |
|---|---|
| Binder resin, exemplified Polyamide N-1) | 1 part (1.0 part by volume) |
| Rutile type titanium oxide A1 (number average primary particle diameter of 35 nm: subjected to surface treatment by a copolymer of methyl hydrogen polysiloxane and dimethylsiloxane, molar ratio = 1:1, in amount of 5 weight % of the titanium oxide) | 3.5 parts (1.0 part by volume) |
| Ethanol/n-propylalcohol/THF (=45/20/30 by weight) | 10 parts |

The above-mentioned composites were mixed, dispersion was performed for 10 hours by a batch system, using a sand mill homogenizer, and whereby intermediate layer dispersion liquid was produced.

Electric Charge Generating Layer (CGL)

The following composition was mixed and dispersed by use of a sand mill, resulting in preparation of a charge generating layer coating solution. This solution was coated on the aforesaid intermediate layer by means of an immersion coating method to form a charge generating layer having a dry layer thickness of 0.3 μm.

| | |
|---|---|
| Titanyl phthalocyanine pigment (titanylphthalocyanine pigment having the maximum peak of Bragg angle 2θ (±0.2°) at 27.3° based on a Cu-Kα characteristic X-ray diffraction spectrum measurement) | 20 parts |
| Polyvinyl butyral silicon denaturalized | 10 parts |
| 4-methoxy-4-methyl-2-pentanone | 700 parts |
| t-Butyl acetate | 300 parts |
| Charge Transporting Layer 1 (CTL 1) | |
| Charge transport substance (N-(4-methylphenyl)-N-[4-(b-phenylstyryl)phenyl]-p-toluidine | 225 parts |
| Polycarbonate (Z300: manufactured by Mitsubishi Gas Chemical Company, Inc.) | 300 parts |
| Anti-oxidant (Exemplified compound 2-1) | 6 parts |
| Dichloromethane | 2000 parts |
| Silicone oil (KF-54: manufactured by Shin-Etsu Chemical Co., Ltd.) | 1 part |

The above composition was mixed and dissolved to prepare a charge transporting layer coating solution. This solution was coated on the aforesaid charge generating layer by means of an immersion coating method and dried at 110° C. for 70 minutes to form the first charge transporting layer having a dry layer thickness of 18.0 μm.

<Preparation of Polytetrafluoroethylene Resin Particle (PTFE Particle) Dispersion Liquid>

PTFE particles having an average primary particle diameter of 0.12 μm and a crystallinity of 91.3 was thermally treated at 250° C. for 40 minutes for making the crystallinity to 82.8, and a PTFE particle dispersion liquid was prepared using the PTFE particles as follows.

| | |
|---|---|
| PTFE particle PT1 (average primary particle diameter: 0.12 μm, crystallinity: 82.2) | 200 parts |
| Toluene | 600 parts |
| Fluorine-containing comb type graft polymer GF300 (TOAGOSEI Co., Ltd.) | 15 parts |

The above composition was mixed and dispersed by a sand grinder, manufactured by Amex Co., Ltd, to prepare a PTFE particle dispersion liquid.

| <Charge Transfer Layer 2 (CTL 2)> | |
|---|---|
| PTFE particle dispersion liquid (whole amount) | 815 parts |
| Charge transport substance (N-(4-methylphenyl)-N-[4-(b phenylstyryl)phenyl]-p-toluidine) | 150 parts |
| Siloxane-modified polycarbonate resin (PC-1) | 150 parts |
| Polycarbonate (Z300: manufactured by a Mitsubishi Gas Chemical Company INC. company) | 150 parts |
| Anti-oxidant (exemplary compound 1-1) | 12 parts |
| THF: Tetrahydrofuran | 2800 parts |
| Silicone oil KF-54 (Shin-Etsu Chemical Co., Ltd. company) | 4 parts |

The above composition was mixed and dissolved to prepare Charge Transfer Layer Coating Liquid 2. The coating liquid was coated on the foregoing Charge Transfer Layer 1 by the circular slide hopper type coating apparatus and dried at 110° C. for 70 minutes to for Charge Transfer Layer 2 (surface layer) having a dried thickness of 2.0 μm. Thus Photoreceptor 1-1 was prepared.

Preparation of Photoreceptors 1-2 Through 1-12

Photoreceptors 1-2 through 1-12 were prepared in the same manner as in Photoreceptor 1-1 except that the N-type semiconductor material in the intermediate layer, binder resin and dried layer thickness, kind and amount of fluorinated resin particle in Charge Transfer Layers 2 (CTL 2) were charged as shown in Table 1.

Preparation of Photoreceptor 1-13

Photoreceptor 1-13 was prepared in the same manner as in Photoreceptor 1-1 except that in place of the ring shaped slider hopper type coating applicator, the Charge Transfer Layer Coating Liquid 2 was coated by using a dipping coating applicator which has a structure basically disclosed in TOKKAIHEI 9-304919 and can coat simultaneously for plural base members.

TABLE 1

| | | Charge transport layer 2 | | | | | | |
|---|---|---|---|---|---|---|---|---|
| Photo-receptor No. | Intermediate layer | Kind of fluoro-resin fine particle | Number average primary particle size | Crystallinity | Added amount (parts) | Coating device | Contact angle | Dispersion of contact angle |
| 1 | 1 | PTFE-1 | 0.12 | 82.2 | 200 | *1 | 112 | 1.3 |
| 2 | 2 | PTFE-2 | 0.03 | 73.4 | 200 | *1 | 115 | 0.7 |
| 3 | 3 | PTFE-3 | 0.19 | 86.2 | 200 | *1 | 108 | 1.8 |
| 4 | 1 | PTFE-4 | 0.01 | 74.6 | 200 | *1 | 95 | 2.2 |
| 5 | 1 | PTFE-5 | 0.22 | 86.4 | 200 | *1 | 98 | 2.3 |
| 6 | 1 | PTFE-6 | 0.12 | 89.1 | 200 | *1 | 107 | 1.6 |
| 7 | 1 | PTFE-7 | 0.12 | 91.3 | 200 | *1 | 105 | 2.2 |
| 8 | 4 | PTFE-1 | 0.12 | 82.2 | 100 | *1 | 92 | 1.9 |
| 9 | 1 | PTFE-1 | 0.12 | 82.2 | 50 | *1 | 88 | 2.4 |
| 10 | 5 | PTFE-1 | 0.12 | 82.2 | 300 | *1 | 118 | 1.1 |
| 11 | 6 | PTFE-1 | 0.12 | 82.2 | 400 | *1 | 128 | 1.0 |
| 12 | 1 | H | 0.12 | 45 | 200 | *1 | 108 | 1.8 |
| 13 | 1 | PTFE-1 | 0.12 | 82.2 | 200 | *2 | 110 | 2.6 |

Content of the interlayer in Table 1 is shown in Table 2.

PTFE, H in Table 1 are the following fluororesin particle.

PTFE represents particles containing tetra fluoro polyethylene.

H represents particles containing copolymer of ethylene trifluoride and ethylene tetrafluoride. In the column of the coating apparatus,

*1 is a ring shaped slide hopper type coating applicator, and

*2 represents dipping coating applicator.

Further, the contact angle and variation of contact angle are measured by the foregoing method and are represented by absolute value.

TABLE 2

| | Intermediate layer | | | | | | | | |
|---|---|---|---|---|---|---|---|---|---|
| | King of N-type semiconductive particles and surface treatment | | | Binder resin | | | | | |
| Intermediate layer No. | Kind of particles | First order particle size (nm) | Surface treatment | Kind | Heat of fusion (J/g) | Water absorbing degree | Ratio of structural unit having 7 or more carbon atoms | Volume ratio | Layer thickness |
| 1 | A1 | 35 | *1 | N-1 | 0 | 1.9 | 100 | 1.0 | 3.0 |
| 2 | A1 | 35 | *2 | N-2 | 0 | 2 | 100 | 0.7 | 3.0 |
| 3 | A1 | 35 | *3 | N-3 | 0 | 2.8 | 45 | 1.0 | 3.0 |
| 4 | A2 | 35 | *4 | N-1 | 0 | 1.9 | 100 | 1.0 | 5.0 |
| 5 | A2 | 35 | *5 | N-1 | 0 | 1.9 | 100 | 2.3 | 10.0 |
| 6 | A1 | 35 | *6 | N-1 | 0 | 1.9 | 100 | 1.0 | 1.0 |

Volume ratio of the interlayer in Table 2 shows volume ratio of the binder resin Vn to the N-type semiconductor material Vb, wherein the interlayer is formed varying the ratio but keeping total volume of them constant.
In Table 2,
A1 and A2 show rutile-type titanium oxide and anatase-type titanium oxide, respectively,
*1 is copolymer of methylhydrogensiloxane and dimethylsiloxane whose molecular ratio of 1:1,
*2 is copolymer of methylhydrogensiloxane and dimethylsiloxane whose molecular ratio of 9:1,
*3 is copolymer of methylhydrogensiloxane and dimethylsiloxane whose molecular ratio of 2:8,
*4 is copolymer of ethylhydrogensiloxane and dimethylsiloxane whose molecular ratio of 1:1,
*5 is copolymer of methylhydrogensiloxane and methylethylsiloxane whose molecular ratio of 1:1, and
*6 is methylhydrogenpolysiloxane.

In Table 2, "surface treatment" is a substance used in the surface treatment of the particles, and The heat of fusion and the water absorbing degree were measured as follows:

Measurement of Heat of Fusion

Measuring apparatus: Shimadzu Flow Rate Differential Scanning Calorimeter DSC-50 manufactured by Shimadzu Corporation.

Measuring condition: The sample to be measured was set in the measuring apparatus and measurement was stated at a room temperature (24° C.). The temperature was raised by 200° C. in a rate of 5° C. per minute and then cooled by the room temperature in a rate of 5° C. per minute. Such the operation was repeated two times and the heat of fusion was calculated from the area of the endothermic peak caused by the fusion in the course the secondary temperature rising.

Measuring Condition of Water Absorption Degree

The sample to be measured was satisfactorily dried at a temperature of from 70 to 80° C. spending 3 to 4 hours and the sample was precisely weighed. After that the sample was put into deionized water kept at 20° C. and taken out after a designated period and water adhered at the surface of the sample was wiped off by a clean cloth, and then the sample was weighed. Such the operation was repeated until the increasing of the weight was saturated. Thus measured increased weight of the sample was divided by the initial weight. The quotient was defined as the water absorption degree.

In the Table 2, "Ratio of structural unit having 7 or more carbon atoms" is the ratio in mole-% of the structural unit having 7 or more carbon atoms between the amide bonds in the structural unit.

<Evaluation>

The photoconductors 1-1 to 1-13 obtained as mentioned above were mounted respectively on EPSONLP-2400 (Epson Co. Ltd. product: printer of 16 sheets of A4 papers/minutes: adopting contact charging with a charging brush and a cleaner less process) which has basically the structure shown in FIGS. 1 and 2 and durability test was conducted under low temperature and low humidity (LL: 10° C., 20% RH) (however, insulation breakdown was evaluated under high-temperature and high humidity (HH: 30° C., 80% RH) condition also). In detail, total 20,000 sheets of a character image and a halftone image were printed, and the evaluation was conducted at the start time and for every 5000 sheets. Evaluation items and criterion for evaluation are shown as follows.

Exposure Condition

Target potential of light-exposure parts: Set the exposure amount to make it less than −50V.

Exposure beam: Image-wise exposure of resolution 600 dpi (dpi is a dot number per 2.54 cm) was performed. Semiconductor laser of 780 nm was used as a laser.

Developing condition: reversal development using nonmagnetic one component developer (nonmagnetic one component developer which has a weight average particle size of 6.3 micrometers and containing hydrophobic titanium oxide of 0.3-micrometer and an external additive agent of 15 nm hydrophobic silica)

Image Density

The reflective density of the image was measured by a densitometer RD-918, manufactured by Macbeth Co., Ltd., the density was expressed by a relative value when the reflective density of the paper was set at 0. The image density was lowered accompanied with a lot of printing. The measurement was carried out for the black solid image of printed after 20,000 sheets of printing.

A: The density was more than 1.2; good.

B: The density was from 1.0 to 1.2; the level on which no problem was caused in the practical use.

C: The density was less than 1.0.

Fogging

Fog density was measured by measuring the reflection density a solid white picture image by using Macbeth RD-918. The reflection density was evaluated with a relative density (the density of A4 paper which is not printed is set to 0.000).

8 [0184)

A; density is less than 0.010 (excellent).

B; density is 0.010 or more and 0.020 or less (it is practically satisfactory level).

C; density is higher than 0.020.

Dash Mark

The occurrence state of the dash marks on the halftone image corresponding to photoconductor cycles was judged according to the following criteria.

A: Dash marks more than 0.4 mm was observed less than 5 per A4 print sheet; good.

B: Dash marks more than 0.4 mm was observed between 6 and 10 per A4 print sheet; no problem was caused in practical use.

C: Dash marks more than 0.4 mm was observed more than 11 per A4 print sheet.

Black Spot

Judged by how many picture image faults of black spots and black streaks per A4 size which can be viewed and has a periodicity conforming with a cycle of a photoconductor.

A; frequency of the picture image fault more than 0.4 mm: less than 5 pieces/A4 in all printed images (excellent).

B; frequency of the picture image fault more than 0.4 mm: more than 6 pieces/A4, and less than 10 pieces/A4 occurred one or more sheets (practically with no problem).

C; frequency of the picture image fault more than 0.4 mm: more than 11 pieces/A4 occurred one or more sheets.

Insulation breakdown; evaluated under low temperature and low humidity (LL: 10° C., 20% RH) and high-temperature and high humidity (30° C., 80% RH).

A; the insulation breakdown of the photoconductor by electric charge leak has no occurred under LL or HH.

C; the insulation breakdown of the photoconductor by electric charge leak has occurred under LL or HH.

Sharpness of a Halftone Picture Image

A; it was reproduced by a clear picture image in which the halftone picture image was uniform and the photoconductor surface was shaved uniformly. (excellent).

B; although the small abrasion mark has occurred on the photoconductor surface, it was reproduced by a clear picture image in which the halftone picture image was uniform (practically with no problem).

C; an abrasion mark occurs on the photoconductor surface and it has become the picture image whose halftone picture image was ruined.

TABLE 3

| Photo-receptor No. | Image density | Fogging | Dash mark | Insulation breakdown | Black spot | Sharpness of a halftone picture image |
|---|---|---|---|---|---|---|
| 1 | A | A | A | B | A | B |
| 2 | A | A | A | B | A | A |
| 3 | A | A | B | B | B | B |
| 4 | B | A | C | B | C | C |
| 5 | B | A | C | B | C | C |
| 6 | A | A | A | B | A | B |
| 7 | B | A | C | B | C | C |
| 8 | A | A | B | B | A | B |
| 9 | B | B | C | B | C | C |
| 10 | A | A | A | B | A | A |
| 11 | A | A | A | B | A | A |
| 12 | B | A | B | B | B | B |
| 13 | C | B | C | C | C | C |

As can be seen from Table 3, the photoconductor of the present invention, that is, any one of organic photoconductors 1-1 to 1-3, 1-6, 1-8, 1-10 to 1-12 having a surface layer (=charge transport layer 2) which contains fluorine-containing resin particles having an average primary particle diameter from 0.02 μm inclusive to 0.20 μm exclusive and a binder resin and the dispersion of the contact angle of ±2.0, generation of dielectric breakdown and black spots, dash mark and blurred images can be prevented, and electrophotographic images in which image density, fogging, sharpness are excellent can be formed. On the other hands, in the photoconductor 1-4 using PTFE-4 having an average primary particle diameter of 0.01 μm, the dispersibility of fluorine-containing resin particles in the surface layer was not good, the fluctuation of contact angles became large to 2.2, black spots and dash mark occurred, and the sharpness of halftone images was deteriorated. Also, in the photoconductor 1-5 using PTFE-5 having an average primary particle diameter of 0.22 μm, the fluctuation of contact angles of the surface layer became large to 2.3, black spots and dash mark occurred, and the sharpness of halftone images was deteriorated. Further, in the photoconductor 1-7, the fluctuation of contact angles of the surface layer became large to 2.2, black spots and dash mark occurred, and the sharpness of halftone images was deteriorated. Further, in the photoconductor 1-9, black spots and dash mark occurred, and the sharpness of halftone images was deteriorated. Further, in the photoconductor which was coated its surface layer (=charge transport layer 2) with an immersion coating apparatus, the fluctuation of contact angles of the surface layer became large to 2.6, black spots and dash mark occurred, the sharpness of halftone images was deteriorated, and dielectric breakdown occurred.

<<Evaluation 1-2>>

The charging brush of the evaluation machine of Evaluation 1-1 was changed into a charging roller shown in FIG. 5, and photoconductors 1-1 to 1-13 were evaluated.

As for the evaluation result of each photoconductor, the result equivalent to Evaluation 1-1 was mostly obtained.

Preparation of Photoreceptor 1-14

The photoconductor 1-14 was prepared with the similar manner with photoconductor 1-1 except that the following conductive layer and intermediate layer were used in place of the intermediate layer of photoconductor 1-1 and the following charge injecting layer was used in place of the charge transport layer 2.

| Conductive layer | |
|---|---|
| Conductive pigment: titanium oxide subjected to tin oxide and antimony oxide coating process | 10 parts |
| Pigment for adjusting resistance: titanium oxide | 10 parts |
| Binder resin: Phenol resin (Plyophen J-325 manufactured by Dainippon Ink &Chemicals, Inc.,) | 10 parts |
| Leveling agent: Silicone oil (SH28PA manufactured by Shin-Etsu Chemical Co., Ltd.,) | 0.001 parts |
| Solvent: methanol/methoxy propanol = 1/1 | 20 parts |

A coating liquid in which the above compositions were mixed and dispersed was coated on the conductive base support with an immersion coating method and the resultant coating layer was heated at 140° C. for 30 minutes, whereby a conductive layer having a layer thickness of 15 μm was obtained.

Next, a coating liquid in which 10 parts of copolymerization polyamide resin (amilan CM-8000, produced by Toray Industries Inc.) and 30 parts of methoxy methylation 6 Nylon (Torezin EF-30T, produced by Teikoku Chemistry company) were dissolved in a mixture solvent of 400 parts of methanol and 200 parts of n-butanol was coated on the above conductive layer with an immersion coating method, and the resultant coating layer was dried with heat wind at 90° C. for 10 minutes, whereby an intermediate layer having a layer thickness of 0.68 μm was obtained. Subsequently, the charge generating layer and the charge transport 1-layer of photoconductor 1 were coated on the above intermediate layer with the similar manner of photoconductor 1-1.

72 parts of antimony dope tin oxide fine particles (a product name T-1, manufactured by MITSUBISHI MATERIALS CORP.) with an average particle diameter of 0.02 μm which was subjected to a surface treatment with methyl hydrogen silicone oil (a product name KF99, manufactured by Shin-Etsu Silicones) and 48 parts of antimony dope tin oxide fine particles (the same with above) with an average particle diameter of 0.02 μm which was subjected to a surface treatment with fluorine denaturation silane coupling agent (a product name LS1090, manufactured by Shin-Etsu Silicones) were dispersed together with 43.2 parts of acrylics monomers (product name TMP3A-3, manufactured by Osaka Organic chemistry) having the following chemical constitution and 210 parts of ethanol by sandmill for 90 hours.

Formula 15

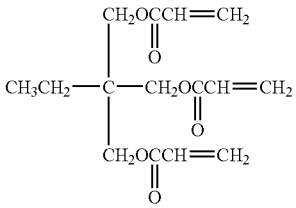

The above liquid was mixed with 200 parts of PTFE particle dispersion used in the charge transport layer 2 of the photoconductor 1 and dispersed with sandmill for 2 hours, further 6.48 parts of 4-diethyltioxaneton as a photopolymerization initiator as 2, and 2.16 parts of 4 and 4'-bis (diethyl amino) benzophenone as start aid agent were added and dissolved in the resultant liquid, whereby charge injecting layer coating solution was produced.

This charge injecting layer coating solution was coated on the charge transport layer 1 with a ring-shaped slide hopper type coating device, photo-curing was performed by. conducting ultraviolet irradiation for 30 seconds with a light intensity of $1.20\times10^{-5}$ W/m$^2$ with a metal halide lamp, after that, hot-air drying was carried out for 1 hour and 40 minutes under 120 C., whereby charge injecting layer (surface layer) of 6 μm of layer thickness were formed. The contact angle of photoconductor 14 was 108°, the dispersion of contact angle was 1.3.

<<Evaluation 1-3>>

Under the evaluation condition of Evaluation 1-1, the charging brush of the charging device shown in FIG. 6 was replaced with a magnetic brush and DC bias of −600 V was applied to the magnetic brush and further AC bias of VPP=650v, Vf=1000 Hz was superposed, thereby charge was injected into the photoconductor, and a surface potential of −600V was provided on the surface of the photoconductor, and then evaluation similar for photoconductor 1-1 was conducted.

The result of the evaluation of the photoconductor 14 is shown in Table 4.

TABLE 4

| Photo-receptor No. | Image density | Fogging | Dash mark | Insulation breakdown | Black spot | Sharpness of a halftone picture image |
|---|---|---|---|---|---|---|
| 14 | A | A | A | B | A | B |

As can be seen from Table 4, in photoconductor 14, generation of dielectric breakdown and black spots, or dash mark and blurred images can be prevented, and electrophotographic images in which image density, fogging, sharpness are excellent can be formed.

Manufacture of Photoconductor 2-1

Photoconductor 2-1 was prepared in the same manner as the photoreceptor 1-1 except that following charge injecting layer was formed in place of Charge Transfer Layer 2 (CTL 2).

Charge Injecting Layer

Preparation of Charge Injecting Layer Coating Solution A

Formula 13

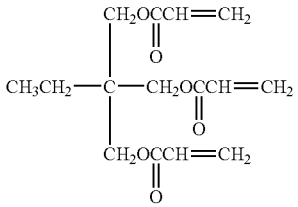

As a charge injecting layer coating solution, 50 parts of antimony dope tin oxide fine particles (T1: produced by MITSUBISHI MATERIALS CORP.) which was subjected to a surface treatment (processing quantity 7%) with a fluorine atom containing compound having the following structural formula 13 and 150 parts of ethanol were dispersed for 66 hours with a sandmill, and further this dispersion was added with 20 parts of PTFE particles (PTFE1: number average primary particle size of 0.12 μm, and degree of crystallinity of 82.2) and were dispersed for 2 hours. Thereafter, 25 parts of Resol type phenol resin (product name: PL-4804, amine compound catalyzer use, manufactured by a GUNEI Chemical Corp.) was added as a resin component into the resultant dispersion, thereby charge injecting layer coating solution A was prepared.

This charge injecting layer coating solution was coated with a ring shaped slide hopper type coater on the above-mentioned charge transporting layer, heating hardening for 70 minutes under 110° C. was performed, whereby the charge injecting layer A with 5.0 μm of dried layer thickness was formed and photoconductor 2-1 was produced.

Preparation of Charge Injecting Layer Coating Solution B

The charge injecting layer coating solution B was prepared with the similar manner in the preparation of charge injecting layer coating solution A except that PTFE particles were changed from PTFE1 to PTFE2 having 0.03 μm of number average primary particle diameters and 73.4% of degree of crystallinity as shown in Table 5.

Preparation of Charge Injecting Layer Coating Solution C

The charge injecting layer coating solution C was prepared with the similar manner in the preparation of charge injecting layer coating solution A except that PTFE particles were changed from PTFE1 to PTFE3 having 0.19 μm of number average primary particle diameters and 86.2% of degree of crystallinity as shown in Table 5.

Preparation of Charge Injecting Layer Coating Solution D

The charge injecting layer coating solution D was prepared with the similar manner in the preparation of charge injecting layer coating solution A except that PTFE particles were changed from PTFE1 to PTFE4 having 0.01 μm of number average primary particle diameters and 74.6% of degree of crystallinity as shown in Table 5.

Preparation of Charge Injecting Layer Coating Solution E

The charge injecting layer coating solution E was prepared with the similar manner in the preparation of charge injecting layer coating solution A except that PTFE particles were changed from PTFE1 to PTFE5 having 0.22 μm of number average primary particle diameters and 86.4% of degree of crystallinity as shown in Table 5.

Preparation of Charge Injecting Layer Coating Solution F

The charge injecting layer coating solution F was prepared with the similar manner in the preparation of charge injecting layer coating solution A except that PTFE particles were changed from PTFE1 to PTFE6 having 0.12 μm of number average primary particle diameters and 89.1% of degree of crystallinity as shown in Table 5.

Preparation of Charge Injecting Layer Coating Solution G

The charge injecting layer coating solution G was prepared with the similar manner in the preparation of charge injecting layer coating solution A except that PTFE particles were changed from PTFE1 to PTFE7 having 0.12 μm of number average primary particle diameters and 91.3% of degree of crystallinity as shown in Table 5.

Preparation of Charge Injecting Layer Coating Solution H

The charge injecting layer coating solution H was prepared with the similar manner in the preparation of charge injecting layer coating solution A except that the antimony dope tin oxide fine particles subjected to a surface treatment with a fluorine atom containing compound having the above structural formula 13 was changed from 50 parts to 20 parts, 30 parts of antimony dope tin oxide fine particles subjected to a surface treatment with methyl hydrogen silicone oil (a product name KF99, manufactured by Shin-Etsu Silicones Co. Ltd.) were further added and the added amount of PTFE1 was changed from 20 parts to 10 parts.

Preparation of Charge Injecting Layer Coating Solution I

The charge injecting layer coating solution I was prepared with the similar manner in the preparation of charge injecting layer coating solution A except that the antimony dope tin oxide fine particles subjected to a surface treatment with a fluorine atom containing compound having the above structural formula 13 was changed to 50 parts of antimony dope tin oxide fine particles (T1: produced by MITSUBISHI MATERIALS CORP.) before being subjected to the surface treatment, 5 parts of a fluorine atom containing compound (a product name LS-1090, manufactured by Shin-Etsu Silicones Co. Ltd.) having the above structural formula 13 and 5 parts of methyl hydrogen silicone oil (a product name KF-99, manufactured by Shin-Etsu Silicones Co. Ltd.) were further added, and the added amount of PTFE1 was changed from 20 parts to 5 parts.

Preparation of Charge Injecting Layer Coating Solution J

The charge injecting layer coating solution J was prepared with the similar manner in the preparation of charge injecting layer coating solution H except that PR-53123 (manufactured by Sumitomo Durezz Co. Ltd) was used in place of a phenol resin of PL-4804, and the added amount of PTFE1 was changed from 10 parts to 30 parts.

Preparation of Charge Injecting Layer Coating Solution K

The charge injecting layer coating solution J was prepared with the similar manner in the preparation of charge injecting layer coating solution H except that PR-50626 (manufactured by Sumitomo Durezz Co. Ltd) was used in place of a phenol resin of PL-4804, and the added amount of PTFE1 was changed from 10 parts to 40 parts.

Preparation of Charge Injecting Layer Coating Solution L

The following compositions were dispersed, whereby charge injecting layer coating solution L was prepared.

| | |
|---|---|
| Bisphenol C type polycarbonate | 10 parts |
| 4-methoxy-4'-(4-methyl-alpha-phenyl styryl) triphenylamine | 3 parts |
| tin oxide | 5 pars |
| H particles (fluorine containing particles having number average primary particle size of 0.12 μm, and degree of crystallinity of 45.0) | 10 parts |
| Tetrahydrofuran | 500 parts |

Preparation of Photoreceptors 2-2 Through 2-12

Photoreceptors 2-2 through 2-12 were prepared in the same manner as in Photoreceptor 2-1 except that the N-type semiconductor material in the intermediate layer, binder resin and dried layer thickness as shown in Table 6, and kind and amount of fluorinated resin particle in Charge injection Layers were changed as shown in Table 5.

Preparation of Photoreceptor 2-13

Photoreceptor 2-13 was prepared in the same manner as in Photoreceptor 2-1 except that in place of the ring shaped slide hopper type coating applicator, the Charge injection Layer Coating Liquid A was coated by using a dipping coating applicator which has a structure basically disclosed in TOKKAIHEI 9-304919 and can coat simultaneously for plural base members.

TABLE 5

| Photo-receptor No. | Intermediate layer | Charge injection layer: Kind of charge injecting layer | Kind of fluoro-resin particle | Number average primary particle size | Crystallinity | Added amount (parts) | Coating device | Contact angle | Dispersion of contact angle |
|---|---|---|---|---|---|---|---|---|---|
| 2-1 | 1 | A | PTFE-1 | 0.12 | 82.2 | 20 | *1 | 112 | 1.2 |
| 2-2 | 2 | B | PTFE-2 | 0.03 | 73.4 | 20 | *1 | 114 | 0.6 |
| 2-3 | 3 | C | PTFE-3 | 0.19 | 86.2 | 20 | *1 | 110 | 1.8 |
| 2-4 | 1 | D | PTFE-4 | 0.01 | 74.6 | 20 | *1 | 95 | 2.3 |
| 2-5 | 1 | E | PTFE-5 | 0.22 | 86.4 | 20 | *1 | 98 | 2.4 |
| 2-6 | 1 | F | PTFE-6 | 0.12 | 89.1 | 20 | *1 | 107 | 1.7 |
| 2-7 | 1 | G | PTFE-7 | 0.12 | 91.3 | 20 | *1 | 105 | 2.2 |
| 2-8 | 4 | H | PTFE-1 | 0.12 | 82.2 | 10 | *1 | 92 | 1.9 |
| 2-9 | 1 | I | PTFE-1 | 0.12 | 82.2 | 5 | *1 | 87 | 2.5 |
| 2-10 | 5 | J | PTFE-1 | 0.12 | 82.2 | 30 | *1 | 118 | 1.2 |
| 2-11 | 6 | K | PTFE-1 | 0.12 | 82.2 | 40 | *1 | 128 | 1.1 |
| 2-12 | 1 | L | H | 0.12 | 45 | 20 | *1 | 108 | 1.8 |
| 2-13 | 1 | A | PTFE-1 | 0.12 | 82.2 | 20 | *2 | 112 | 2.7 |

TABLE 6

| Intermediate layer No. | Intermediate layer: King of N-type semiconductive particles and surface treatment: Kind of particles | Primary particle size (nm) | Surface treatment | Binder resin: Kind | Heat of fusion (J/g) | Water absorbing degree | Ratio of structural unit having 7 or more carbon atoms | Volume ratio | Layer thickness |
|---|---|---|---|---|---|---|---|---|---|
| 1 | A1 | 35 | *1 | N-1 | 0 | 1.9 | 100 | 1.0 | 3.0 |
| 2 | A1 | 35 | *2 | N-2 | 0 | 2 | 100 | 0.7 | 3.0 |
| 3 | A1 | 35 | *3 | N-3 | 0 | 2.8 | 45 | 1.0 | 3.0 |
| 4 | A2 | 35 | *4 | N-1 | 0 | 1.9 | 100 | 1.0 | 5.0 |
| 5 | A2 | 35 | *5 | N-1 | 0 | 1.9 | 100 | 2.3 | 10.0 |
| 6 | A1 | 35 | *6 | N-1 | 0 | 1.9 | 100 | 1.0 | 1.0 |

<<Evaluation 2-1>>

The same procedure with Evaluation 1-1 was conducted for Photoreceptor 2-1 to 2-13, the result is shown in Table 7.

TABLE 7

| Photo-receptor No. | Image density | Fogging | Dash mark | Insulation breakdown | Black spot | Sharpness of a halftone picture image |
|---|---|---|---|---|---|---|
| 2-1 | A | A | A | B | A | B |
| 2-2 | A | A | A | B | A | A |
| 2-3 | A | A | B | B | B | B |
| 2-4 | B | A | C | B | C | C |
| 2-5 | B | A | C | B | C | C |
| 2-6 | A | A | A | B | A | B |
| 2-7 | B | A | C | B | C | C |
| 2-8 | A | A | B | B | A | B |
| 2-9 | B | B | C | B | C | C |
| 2-10 | A | A | A | B | A | A |
| 2-11 | A | A | A | B | A | A |
| 2-12 | B | A | B | B | B | B |
| 2-13 | C | B | C | C | C | C |

As can be seen from Table 7, the photoconductor of the present invention, that is, any one of organic photoconductors 2-1 to 2-3, 2-6, 2-8, 2-10 to 2-12 having a charge injecting layer which contains fluorine-containing resin particles having an average primary particle diameter from 0.02 μm inclusive to 0.20 μm exclusive and a binder resin and which has a dispersion of contact angle of ±2.0, generation of dielectric breakdown and black spots, or dash mark and blurred images can be prevented, and electrophotographic images in which image density, fogging, sharpness are excellent can be formed.

On the other hands, in the photoconductor 2-4 using PTFE-4 having an average primary particle diameter of 0.01 μm, the dispersibility of fluorine-containing resin particles in the charge injecting layer was not good, the fluctuation of contact angles became large to 2.2, black spots and dash mark occurred, and the sharpness of halftone images was deteriorated. Also, in the photoconductor 2-5 using PTFE-5 having an average primary particle diameter of 0.22 μm, the fluctuation of contact angles of the charge injecting layer became large to 2.3, black spots and dash mark occurred, and the sharpness of halftone images was deteriorated. Further, in the photoconductor 2-7 using PTFE-7, the fluctuation of contact angles of the charge injecting layer became large to 2.2, black spots and dash mark occurred, and the sharpness of halftone images was deteriorated. Further, in the photoconductor 2-9, black spots and dash mark occurred, and the sharpness of halftone images was deteriorated. Further, in the photoconductor which was coated its charge injecting layer with an immersion coating apparatus, the fluctuation of contact angles of the charge injecting layer became large to 2.6, black spots and dash mark occurred, the sharpness of halftone images was deteriorated, and dielectric breakdown occurred.

<<Evaluation 2-2>>

The charging brush of the evaluation machine of Evaluation 2-1 was changed into a charging roller shown in FIG. 5, and photoconductors 2-1 to 2-13 were evaluated.

As for the evaluation result of each photoconductor, the result equivalent to Evaluation 2-1 was mostly obtained.

<<Evaluation 2-3>>

The charging brush of the evaluation machine of Evaluation 2-1 was changed into a magnetic brush shown in FIG. 6, and photoconductors 2-1 to 2-13 were evaluated.

As for the evaluation result of each photoconductor, the result equivalent to Evaluation 2-1 was mostly obtained.

By using the organic photoconductor of the invention, problems such as generation of image defects, dielectric breakdown, black spots or dash marks can be solved, whereby forming a high precise half tone image can be formed. Further, it is possible to provide a process cartridge and an image forming apparatus employing the organic photoconductor.

What is claimed is:

1. An image forming apparatus, comprising:

an organic photoconductor having a surface layer containing fluorine-containing resin particles whose number average primary particle size is from not less than 0.02 μm to less than 0.20 μm, wherein the surface layer has a contact angle for water and the dispersion of the contact angle is ±2.0°; and a charging device to charge the organic photoconductor by bringing a rotatable charging member in contact with the organic photoconductor, wherein the degree of crystallinity of the fluorine-containing resin particles is not less than 40% and less than 90%.

2. The image forming apparatus of claim 1, wherein the surface layer has a contact angle for water of 90° or more.

3. The image forming apparatus of claim 1, wherein the organic photoconductor comprises a charge generating layer and plural charge transport layers provided on a conductive support, and the surface layer is the uppermost layer of the charge transport layers.

4. The image forming apparatus of claim 1, wherein the surface layer is a charge injecting layer.

5. The image forming apparatus of claim 4, wherein the charge injecting layer contains conductive particles and a binder resin.

6. The image forming apparatus of claim 5, wherein the conductive particles are metal or metal oxide particles.

7. The image forming apparatus of claim 6, wherein the binder resin is a hardened resin.

8. The image forming apparatus of claim 7, wherein the hardened resin is at least one selected from the group consisting of a phenol resin, an acryl resin, an epoxy resin, and a siloxane resin.

9. The image forming apparatus of claim 4, wherein the charge injecting layer contains an antioxidant.

10. The image forming apparatus of claim 4, wherein the organic photoconductor comprises a charge generating layer and a charge transporting layer.

11. The image forming apparatus of claim 1, wherein the surface layer contains a polycarbonate modified with siloxane.

12. The image forming apparatus of claim 1, wherein the surface layer contains an antioxidant.

13. A method for forming an electrophotographic image, comprising:

charging an organic photoconductor by bringing a rotatable charging member in contact with the organic photoconductor, wherein the organic photoconductor comprises a conductive support and a surface layer containing fluorine-containing resin particles whose number average primary particle size is not less than 0.02 μm and is less than 0.20 μm, the surface layer has a contact angle for water and the dispersion of the contact angle is ±2.0° , and the degree of crystallinity of the fluorine-containing resin particles is not less than 40% and less than 90%.

14. The method of claim 13, wherein the organic photoconductor comprises a photosensitive layer provided on the conductive support, and the surface layer is a charge injecting layer.

15. The method of claim 13, wherein the organic photoconductor comprises a photosensitive layer provided on the conductive support.

16. The method of claim 13, wherein the surface layer is a charge injecting layer including a binder and the fluorine-containing resin particles in an amount of 20 to 200 parts by mass of 100 parts of the binder.

17. A process cartridge for use in an image forming apparatus comprising:

a supporting member to support in one body an organic photoconductor having a surface layer containing fluorine-containing resin particles whose number average primary particle size is from not less than 0.02 μm to less than 0.20 μm and the degree of crystallinity is not less than 40% and less than 90%, and the surface layer has a contact angle for water and the dispersion of the contact angle is ±2.0°, and at least one member selected from the group consisting of, a charging device to charge the organic photoconductor by bringing a rotatable charging member in contact with the organic photoconductor, a latent image forming device, a developing device, a transferring device and a charge eliminating device, wherein the process cartridge is adapted to be mounted or dismounted freely on the image forming apparatus.

18. The image forming apparatus of claim 1, wherein the rotatable charging member is a rotatable charging brush.

19. The image forming apparatus of claim 1, wherein the rotatable charging member is a rotatable charging roller.

20. The image forming apparatus of claim 1, wherein the rotatable charging member is a rotatable magnetic brush.

* * * * *